US011337493B2

(12) United States Patent
Hooper et al.

(10) Patent No.: US 11,337,493 B2
(45) Date of Patent: May 24, 2022

(54) APPARATUSES AND SYSTEMS FOR CLOSURE OF FOOTWEAR

(71) Applicant: FACTOR 10 LLC, New Orleans, LA (US)

(72) Inventors: Luke Hooper, New Orleans, LA (US); Valerie Draves, Madison, WI (US); Daniel Whitsell, Lebanon, OH (US)

(73) Assignee: FACTOR 10 LLC, New Orleans, LA (US)

( * ) Notice: Subject to any disclaimer, the term of this patent is extended or adjusted under 35 U.S.C. 154(b) by 646 days.

(21) Appl. No.: 15/425,821

(22) Filed: Feb. 6, 2017

(65) Prior Publication Data

US 2017/0224055 A1 Aug. 10, 2017

Related U.S. Application Data

(60) Provisional application No. 62/291,977, filed on Feb. 5, 2016, provisional application No. 62/327,090, filed on Apr. 25, 2016.

(51) Int. Cl.
*A43C 11/14* (2006.01)
*A43B 3/12* (2006.01)
(Continued)

(52) U.S. Cl.
CPC ..... *A43C 11/1493* (2013.01); *A43B 1/0054* (2013.01); *A43B 3/126* (2013.01);
(Continued)

(58) Field of Classification Search
CPC ... A43C 11/1493; A43C 11/165; A43B 3/122; A43B 3/126
(Continued)

(56) References Cited

U.S. PATENT DOCUMENTS 1,686,175 A * 10/1928 Read ..... A43B 3/101 36/58.5
1,793,212 A * 2/1931 Dike ..... A43B 3/16 36/50.1
(Continued)

FOREIGN PATENT DOCUMENTS

CN 2438353 7/2001
DE 20112330 11/2001
(Continued)

OTHER PUBLICATIONS

Susan Anderson, "Vendante POP BANDS(TM) | Fun and Safety for Halloween: Super-Reflective, Colorful Way to Make Goblins Visible to Cars at Night", Oct. 8, 2014, www.prweb.com/releases/halloween/2014/prweb12225212.htm.

*Primary Examiner* — Megan E Lynch
(74) *Attorney, Agent, or Firm* — Jason P. Mueller; FisherBroyles, LLP

(57) ABSTRACT

Methods and apparatuses are provided for closure of footwear. According to an example embodiment, an article of footwear that automatically secures to a user's foot includes a sole and a closure mechanism with a first portion and a second portion. The first portion of the closure mechanism is attached to the sole. The second portion extends away from the sole. Deformation of a surface of the closure mechanism actuates the closure mechanism such that it automatically moves from a first stable position to a second stable position. In the second stable position, the closure mechanism conforms to and applies a force to at least one of an upper surface of the article of footwear and an upper surface of a foot of a user of the article of footwear.

4 Claims, 20 Drawing Sheets

(51) Int. Cl.
*A43C 11/00* (2006.01)
*A43B 1/00* (2006.01)
*A43B 13/12* (2006.01)
*A43B 13/14* (2006.01)

(52) U.S. Cl.
CPC ..... *A43B 13/12* (2013.01); *A43B 13/14* (2013.01); *A43C 11/00* (2013.01); *A43C 11/008* (2013.01)

(58) Field of Classification Search
USPC ..... 36/50.1, 97, 101, 100, 27, 108, 150, 151
See application file for complete search history.

(56) References Cited

U.S. PATENT DOCUMENTS 3,436,842 A * 4/1969 Sachs ..... A43B 23/28 36/58.5
4,114,296 A * 9/1978 Smith ..... A43B 3/122 36/101
4,476,639 A * 10/1984 Zaccaria ..... A43B 5/00 36/114
4,670,999 A * 6/1987 Olivieri ..... A43B 5/0449 36/117.7
4,924,605 A * 5/1990 Spademan ..... A43B 5/00 36/114
5,054,216 A * 10/1991 Lin ..... A43B 3/00 36/138
5,148,614 A * 9/1992 Kelly ..... A43B 11/00 36/1
5,205,055 A * 4/1993 Harrell ..... A43B 5/1633 36/50.1
5,481,814 A 1/1996 Spencer
5,682,687 A * 11/1997 Arai ..... A43B 3/30 36/112
5,839,210 A * 11/1998 Bernier ..... A43B 1/0072 36/138
5,983,530 A * 11/1999 Chou ..... A43C 1/04 36/118.1
5,991,950 A * 11/1999 Schenkel ..... A43B 3/122 12/142 T
6,032,387 A * 3/2000 Johnson ..... A43C 1/06 36/118.1
6,035,556 A 3/2000 Ballinger et al.
6,351,897 B1 * 3/2002 Smith ..... A43C 11/14 36/50.1
6,378,230 B1 * 4/2002 Rotem ..... A43C 11/16 36/118.1
6,427,361 B1 * 8/2002 Chou ..... A43B 11/00 36/138
6,739,615 B1 * 5/2004 Maravetz ..... A43B 5/0401 280/11.36
6,896,128 B1 * 5/2005 Johnson ..... A43C 1/06 36/118.1
7,059,069 B2 6/2006 Raluy et al.
7,178,270 B2 2/2007 Hurd et al.
7,581,337 B2 * 9/2009 Miller ..... A43B 1/0072 36/102
7,793,438 B1 * 9/2010 Busse ..... A43B 11/02 36/105
8,001,704 B2 * 8/2011 Baudouin ..... A43B 7/1495 36/102
8,087,188 B2 1/2012 Labbe
8,499,474 B2 8/2013 Kaufman
9,254,018 B2 * 2/2016 Bliss ..... A43C 11/00
9,392,844 B1 * 7/2016 Burrell ..... A43B 23/24
9,414,640 B2 8/2016 Nichols
2001/0034958 A1 * 11/2001 Kaneko ..... A43B 23/08 36/58.5
2002/0035795 A1 * 3/2002 Smith ..... A43C 11/00 36/50.1
2003/0009917 A1 * 1/2003 Voswinkel ..... A43B 11/00 36/50.1
2003/0145490 A1 * 8/2003 Tsai ..... A43B 3/244 36/15
2004/0072482 A1 4/2004 Runyan
2005/0039348 A1 * 2/2005 Raluy ..... A43B 3/12 36/50.1
2005/0081404 A1 4/2005 Hurd et al.
2005/0102864 A1 * 5/2005 Levy ..... A43B 3/00 36/132
2007/0209234 A1 * 9/2007 Chou ..... A43C 11/00 36/50.1
2008/0086911 A1 * 4/2008 Labbe ..... A43B 11/00 36/50.1
2008/0307673 A1 * 12/2008 Johnson ..... A43B 11/00 36/50.1
2009/0019736 A1 * 1/2009 Ng ..... A43B 3/06 36/25 R
2009/0223084 A1 * 9/2009 Kaufman ..... A43C 11/008 36/43
2009/0272007 A1 * 11/2009 Beers ..... A43B 3/0005 36/50.1
2011/0146106 A1 * 6/2011 Kaufman ..... A43C 11/00 36/105
2011/0258876 A1 * 10/2011 Baker ..... A43C 11/008 36/50.1
2013/0219751 A1 * 8/2013 Catlett ..... A43B 3/122 36/101
2014/0338225 A1 * 11/2014 Bliss ..... A43C 11/00 36/83
2015/0003047 A1 * 1/2015 Lin ..... F21V 31/005 362/103
2015/0216252 A1 8/2015 Wiens
2016/0058128 A1 * 3/2016 Dalton ..... A43C 7/06 36/50.1
2016/0073739 A1 * 3/2016 James ..... A43B 11/00 36/97
2016/0143397 A1 5/2016 Alvarez
2016/0214332 A1 * 7/2016 Zhao ..... B29C 70/46
2016/0302530 A1 * 10/2016 Smith ..... A43C 11/004
2016/0345695 A1 12/2016 Stagge
2017/0027275 A1 2/2017 Nava
2017/0055642 A1 3/2017 Krengel

FOREIGN PATENT DOCUMENTS

DE 102009023689 12/2010
EP 1952715 8/2008
KR 2017016170 A * 8/2015 ..... A43B 23/027
WO 2003/039283 3/2003
WO 2009/134858 11/2009

* cited by examiner

APPARATUSES AND SYSTEMS FOR CLOSURE OF FOOTWEAR

CROSS-REFERENCE TO RELATED APPLICATIONS

This application claims the benefit of U.S. Provisional Patent Application Nos. 62/291,977 and 62/327,090, filed Feb. 5, 2016 and Apr. 25, 2016, respectively, which are incorporated herein by reference.

DESCRIPTION

Figure 1:
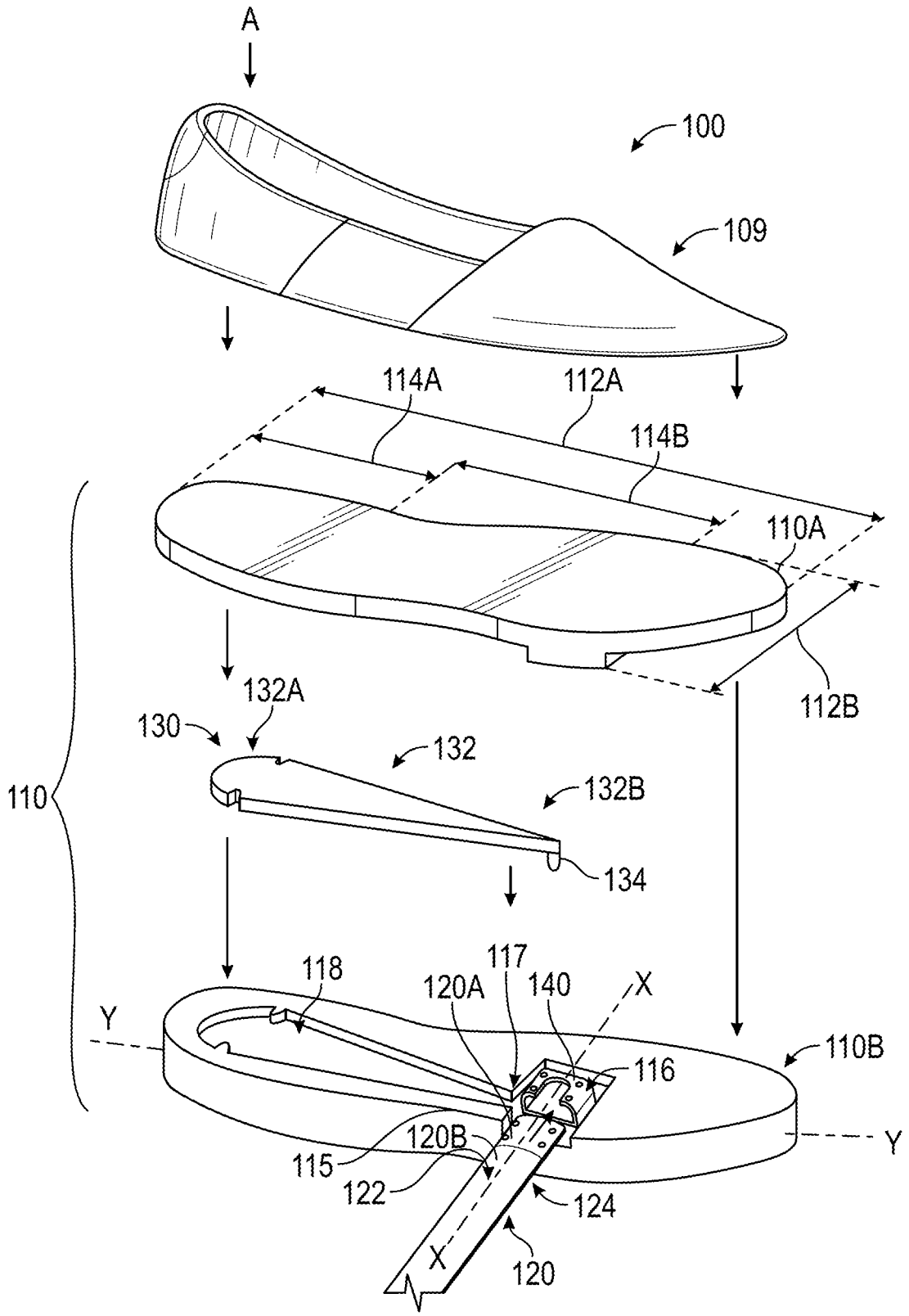
FIG. 1 is an exploded perspective view of an article of footwear, according to an example embodiment of the present invention.

The present invention relates generally to articles of footwear. Embodiments of the present invention provide methods and apparatuses for closure of footwear, in particular, for automatically securing an article of footwear to a user's foot. Embodiments of the present invention include articles of footwear that automatically secure to a user's foot. Embodiments of the present invention provide closure systems for articles of footwear that automatically secure articles of footwear to a user's foot.

Example embodiments of the present disclosure employ bi-stable closure mechanisms to automatically secure an article of footwear to a user's foot. Bi-stable mechanisms have two, low stress equilibrium states in which no external force is required to maintain the structural configuration. Deforming a convex top surface of a bi-stable closure mechanism causes it to rapidly shift from an elongated, open-foot receiving position and arc or wrap around a user's foot towards a secured, closed-foot position. In embodiments of the present invention, thehe convex top surface can be deformed by lightly slapping the closure mechanism, by applying direct pressure from the user's foot, or by way of a mechanical, pneumatic, and/or electrical trigger mechanism.

In example embodiments, bi-stable mechanisms discussed herein are modified to have additional, intermediate stable positions. Intermediate stable positions are low stress equilibrium states that exist between the two traditional stable positions found in bi-stable mechanisms. Mechanisms with intermediate stable positions may be used to optimize closure characteristics of the closure mechanism, including timing, positioning and force asserted by the closure mechanism. Mechanisms with intermediate stable positions may be used to ease the insertion of a user's foot into an article of footwear.

According to an example embodiment, an article of footwear that automatically secures to a user's foot includes a sole with a first cavity and a second cavity, a bi-stable closure mechanism with a first portion and a second portion, and a trigger mechanism configured to activate the bi-stable closure mechanism. The sole includes a length, a width, a heel portion, and a midfoot portion. The first cavity extends across a part of the width of the midfoot portion of the sole toward an outer edge of the sole. The first portion of the bi-stable closure mechanism extends within the first cavity, and the second portion extends away from the sole. The second cavity extends from the heel toward the midfoot portion of the sole. A trigger mechanism including an elongated rigid member extends within the second cavity. The first end of the rigid member, located within the heel, is arranged to receive a downward force from a user of the footwear and transfer the force to the second end of the rigid member. The second end of the rigid member is arranged to deform the surface of the first portion of the closure mechanism and activate the second portion. Upon activation, the second portion of the closure mechanism moves from a first stable position towards a second stable position, wrapping around the top surface of the article of footwear or the user's foot.

The closure mechanism may include a bi-stable spring.

The bi-stable spring may be substantially straight in the first stable position. The bi-stable spring may include an elongated piece of metal with a curvature about its longitudinal axis. Deformation of a convex top surface of the bi-stable closure mechanism may cause it to release from the first stable position and automatically wrap around an axis transverse to the longitudinal axis and towards the second stable position.

The second portion of the closure mechanism may extend substantially perpendicular to an outer edge of the midfoot portion of the sole when the closure mechanism is in the first stable position.

The midfoot portion may be located in at least one of a medial area of the sole and a lateral area of the sole.

According to an example embodiment, an article of footwear that automatically secures to a user's foot includes a sole and a closure mechanism with a first portion and a second portion. The first portion of the closure mechanism is attached to the sole. The second portion extends away from the sole. Deformation of a surface of the closure mechanism actuates the closure mechanism such that it automatically moves from a first stable position to a second stable position. In the second stable position, the closure mechanism conforms to and applies a force to at least one of an upper surface of the article of footwear and an upper surface of a foot of a user of the article of footwear.

The closure mechanism may be bi-stable.

The second portion of the closure mechanism may extend substantially perpendicular to a midfoot portion of the sole when the closure mechanism is in the first stable position.

The sole may include a first cavity, an insole, and a midfoot portion. The first cavity may be located in the midfoot and covered by the insole. The first portion of the closure mechanism may be located within the first cavity.

The article of footwear may include a sleeve secured to the sole. The first portion of the closure mechanism may be located within the sleeve.

The article of footwear may include a trigger mechanism configured to deform the surface of the closure mechanism.

The trigger mechanism may include a mechanical system, a pneumatic system and an electrical system.

The trigger mechanism may include an elongated rigid member. The elongated rigid member may be configured to transfer a force from the user of the footwear to the surface of the closure mechanism, causing the surface of the closure mechanism to deform.

The rigid member may extend from the heel to the midfoot portion of the sole. A first end of the rigid member may be located in the heel portion of the sole. The second end of the rigid member may be located in the midfoot portion of the sole. The first end may be configured to receive and transfer a downward force from a user's foot to the second end of the rigid member. The second end may be configured to deform the surface of the closure mechanism.

The part of the first end of the rigid member that receives the downward force may have a surface area larger than the part of the second end of rigid member that acts on the surface of the closure mechanism.

The sole may include a length, a width, a heel and a midfoot portion. A first cavity may extend across at least a part of the width of the sole and toward the midfoot portion. A second cavity may extend from the heel toward the midfoot portion. The first portion of the closure mechanism may extend within the first cavity and toward the midfoot portion. The trigger mechanism may be located within the second cavity, and may include an elongated rigid member that extends from the heel toward the midfoot portion. The rigid member may have a first end located in the heel and a second end that acts on the closure mechanism. The first end of the rigid member may be configured to receive a force from the user's foot, and the rigid member transfers the force to the second end of the rigid member such that it's capable of deforming the surface of the closure mechanism.

The closure mechanism may include a bi-stable spring.

The bi-stable spring may include an elongated piece of metal with a curvature about its longitudinal axis. Deformation of a convex top surface of the closure mechanism may cause it to release from a substantially straight first stable position and automatically wrap around an axis transverse to the longitudinal axis and towards the second stable position.

The midfoot portion may be located in at least one of a medial area of the sole and a lateral area of the sole.

The second portion of the closure mechanism may include a securing mechanism that attaches to the article of footwear or the sole.

The securing mechanism may include a first Velcro surface and a first magnetic surface that mate, respectively, with a second Velcro surface and a second magnetic surface on the article of footwear or the sole.

According to an example embodiment, an article of footwear that automatically secures to a user's foot includes a sole having a side portion and an elongated spring member secured to the sole that extends away from the side portion of the sole. Deformation of a surface of the spring member releases the spring member and causes a portion of the spring member to move from a first stable position towards a second stable position and wrap around at least one of an upper surface of the article of footwear and a user's foot.

The spring member may include an elongated piece of metal that has a curvature about its longitudinal axis. Deformation of a convex top surface of the closure mechanism may cause a portion of the spring member to release from a substantially straight first stable position and automatically wrap around an axis transverse to the longitudinal axis and towards the second stable position.

According to an example embodiment, a closure system for an article of footwear includes an elongated spring member that is in an open foot receiving position when the spring member is in a first stable position. Deformation of a surface of the spring member may cause the spring member to release from the first stable position and move towards a second stable position, wrapping around and exerting a force against the user's foot.

The closure system may include an actuator secured to the footwear that deforms the surface of the spring member.

The spring member may be a bi-stable spring.

A cross section of the spring member may have at least one of a convex shape and a concave shape in the first stable position, and a generally flat shape after deformation of the surface of the spring member.

The closure system may include a securing mechanism that attaches a portion of the spring member to the article of footwear.

The spring member may be elongated, having a width, a length, and a longitudinal central axis running along the length. In the first stable position, the spring member may extend substantially straight along the length, and a cross-section of the width of the spring member may have a curvature about the longitudinal central axis. The deformation may be a deformation of a convex top surface of the closure mechanism that causes the closure mechanism to release from the first stable position and automatically wrap around an axis transverse to the longitudinal central axis and towards the second stable position.

Referring to FIGS. 1 to 5, an article of footwear 100 is shown. Footwear 100 includes an upper shoe portion 109, a sole 110, a closure mechanism 120, and a trigger mechanism 130.

FIG. 1 illustrates an exploded view of article of footwear 100. Sole 110 has a length 112A, a width 112B, a heel portion 114A, and a midfoot portion 114B. While heel portion 114A and midfoot portion 114B are shown with a particular configuration in FIG. 1, heel portion 114A and midfoot portion 114B are not limited to this arrangement. Midfoot portion 114B may extend farther into heel portion 114A than shown in FIG. 1, and/or midfoot portion 114B may extend the full length 112A of sole 110, notwithstanding heel portion 114A.

Sole 110 includes an upper sole 110A and a lower sole 110B. Upper shoe portion 109 attaches to upper sole 110A. Upper sole 110A interfaces directly with a user's foot, and covers lower sole 110B. Lower sole 110B includes a first cavity 116 and a second cavity 118. Though sole 110 is shown with two cavities 116 and 118 in FIG. 1, it will be appreciated that sole 110 may not be limited to this arrangement. Sole 110 may have a single cavity 116, or a multitude of cavities in addition to cavities 116 and 118.

As shown in FIG. 1, first cavity 116 extends across a portion of width 112B and length 112A of lower sole 110B in midfoot portion 114B. Second cavity 118 extends across a portion of width 112B and length 112A of lower sole 110B from heel portion 114A toward midfoot portion 114B. Second cavity 118 and first cavity 116 meet at an intersection point 117 in midfoot portion 114B. While cavities 116 and 118 are shown in a specific arrangement in FIG. 1, it will be appreciated that cavities 116 and 118 may not be limited to this arrangement. Cavities 116 and 118 may have different shapes and orientations, e.g., cavity 116 may be angled/oriented within lower sole 110B and/or have other configurations, so long as first portion 120A of closure mechanism 120 is fixed to sole 110 in such a way as to permit second portion 120B to wrap around a user's foot and/or upper shoe portion 109.

Closure mechanism 120 includes a first portion 120A, a second portion 120B, and a convex top surface 122. Top surface 122 extends the length of closure mechanism 120 along axis X. First portion 120A extends within first cavity 116. Second portion 120B extends away from sole 110 in a direction substantially perpendicular to outer edge 115 when in a first stable position 124. While shown in FIG. 1 as perpendicular to outer edge 115, second portion 120B can extend away from outer edge 115 in other directions, e.g., in a direction at an angle relative to outer edge 115, so long as section portion 120B wraps around a portion of a user's foot and/or upper shoe portion 109 upon actuation and provides functionality as described herein.

Closure mechanism 120 may be made of steel, carbon fiber, and/or a composite material. Closure mechanism 120 may have varying thicknesses. In an embodiment closure mechanism 120 has a thickness from approximately 0.1 mm to approximately 0.5 mm. Closure mechanisms described herein may be made of various materials and may have variable thicknesses, including varying thicknesses along a length of a particular closure mechanism, as long they retain the critical features necessary for securing a user's foot to an article of footwear. Closure mechanism 120 is configured such that deformation of top surface 122 causes closure mechanism 120 to automatically shift from an open-foot receiving first stable position 124 and wrap around a user's foot and/or upper shoe portion 109 to a closed-foot second stable position 126. The closure mechanisms described herein may be configured such that it automatically wraps around a user's foot or an article of footwear while moving toward a second state of equilibrium. The closure mechanisms described herein may not reach that second state of equilibrium but instead come to rest on a top surface of a user's foot and/or a portion of the article of footwear, ie, a second stable position. The second stable position may be the second state of equilibrium or some point before that state such that closure mechanism is stabilized by the article it is wrapping around or is held in place by a fastening mechanism, e.g., the securing mechanisms described herein.

Closure mechanism 120 may have various configurations, e.g., as described herein, such that it has the desired securing properties for a particular article of footwear, including rate of closure and amount and direction of force asserted on an article of footwear or user's foot. While shown in FIG. 1 with a trigger mechanism 130 configured to deform top surface 122, footwear 100 is not limited to this configuration. A user of footwear 100 may deform top surface 122 manually by hand, or by inserting a foot into footwear 100 and rotating it such that top surface 122 is compressed between the ground and the exterior of article of footwear 100.

As shown in FIG. 1, trigger mechanism 130 extends within second cavity 118. Trigger mechanism 130 includes an elongated rigid member 132 having a first end 132A and a second end 132B. First end 132A extends within heel portion 114A of second cavity 118. Second end 132B extends within midfoot portion 114B of second cavity 118 toward the intersection 117 of first cavity 116 and second cavity 118. Second end 132B includes a spherical application point 134 that rests above convex top surface 122 of first portion 120A in first cavity 116. When a user applies downward force A to heel portion 114A of upper sole 110A, spherical application point 134 is configured to lower into first cavity 116 and deform convex top surface 122 of first portion 120A. Deformation of convex top surface 122 actuates second portion 120B such that it automatically and rapidly wraps around a user's foot and/or upper shoe portion 109 to reach a closed, second stable position 126. While shown as spherical in FIG. 1, application point 134 may have other shapes so long as it is configured to deform convex top surface 122 of closure mechanism 120.

The surface area of rigid member 132 is configured to decrease as first end 132A extends toward second end 132B. The larger surface area of first end 132A accommodates variations in gait and weight that may alter the location and pressure of downward force A as exerted by an individual user's foot on heel portion 114A. The smaller surface area of second end 132B and spherical application point 134 are configured to focus the pressure of downward force A such that it deforms convex top surface 122 of closure mechanism 120. Deformation of top surface 122 actuates closure mechanism 120, causing it to rapidly shift from an open-foot receiving first stable position 124 and wrap around a user's foot and/or upper shoe portion 109 to a closed-foot second stable position 126. While trigger mechanism 130 is shown in a specific arrangement in FIG. 1, it will be appreciated that trigger mechanism 130 may not be limited to this arrangement. Trigger mechanism 130 may have different shapes and orientations, provided that they enable trigger mechanism 130 to deform top surface 122 of closure mechanism 120.

Though not shown in FIG. 1, first cavity 116 and second cavity 118 may include additional components that aid in transferring downward force A from first end 132A to second end 132B of trigger mechanism 130. Compressible materials may be included beneath first end 132A in second cavity 118 to elevate first end 132A relative to second end 132B. The elevation may aid in transferring downward force A from first end 132A across rigid member 132 to second end 132B such that application point 134 deforms convex top surface 122. While not shown in FIG. 1, footwear 100 may include a rigid surface positioned beneath rigid member 132 and first portion 120A in lower sole 110B. The rigid surface may extend across second cavity 118, intersection 117 and a portion of first cavity 116 from first end 132A to second end 132B. The rigid surface may be configured to mirror rigid member 132 and provide an upward force that opposes downward force A. The two opposing forces may compress top surface 122 of closure mechanism 120 to activate closure of second portion 120B.

Referring to FIG. 1, first portion 120A of closure mechanism 120 is configured to be enclosed within a sleeve 140. Sleeve 140 extends through a portion of first cavity 116 of lower sole 110B. As shown in FIG. 1, sleeve 140 includes holes configured to align with holes in first portion 120A of closure mechanism 120. Securing attachments including screws, thread, and/or bolts may extend through the holes, interfacing with first cavity 116 and securing sleeve 140 and first portion 120A of closure mechanism 120 to sole 110. Sleeve 140 is configured to limit the exposed surface area of convex top surface 122, thereby preventing accidental actuation of closure mechanism 120. Sleeve 140 is also configured to prevent first portion 120A from shifting within first cavity 116. Sleeve 140 may also provide structure to facilitate assembly of the article of footwear during manufacture. Sleeve 140 may include semi-rigid materials, e.g., plastic, rubber, silicone, and/or composite materials. While shown in FIG. 1 with sleeve 140, it will be appreciated that closure mechanism 120 does not have to be enclosed by sleeve 140. In other embodiments, first portion 120A may be secured directly to first cavity 116 of sole 110, e.g., by using mechanical systems (e.g., fasteners, etc.) and/or adhesive systems (e.g., glues, epoxies, etc.). In other embodiments, first portion 120A and/or trigger mechanism 130 may be directly molded within sole 110 and may eliminate the need for upper sole 110A.

In FIGS. 2 to 5, closure mechanism 120 is shown within an enclosure 127. Enclosure 127 includes a flexible fabric that surrounds closure mechanism 120. Enclosure 127 protects a user of footwear 100 from exposed metal, carbon fiber, etc. from closure mechanism 120. Enclosure 127 may be configured to limit the closure rate of closure mechanism 120. Enclosure 127 may be arranged to control the arc shape of second portion 120B such that it conforms to the shape of a user's foot in second stable position 126. While shown in FIGS. 2 to 5 as a flexible fabric, enclosure 127 may include other flexible materials of varying elasticity and thickness, e.g., rubber, silicone, and/or composite materials.

Figure 2:
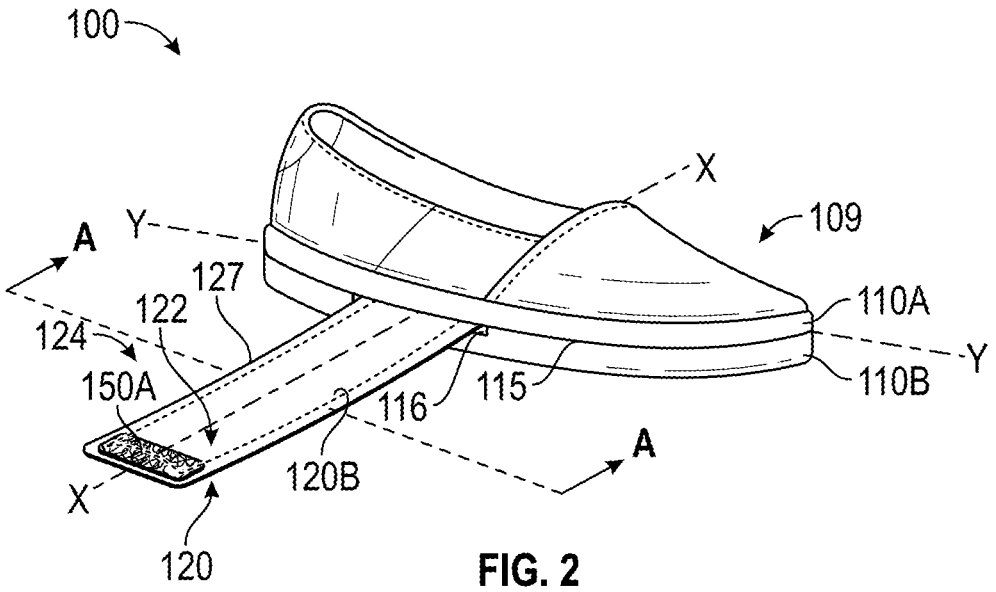
FIG. 2 is a perspective view of the article of footwear with a closure mechanism in a first stable position.

FIG. 2 illustrates article of footwear 100 with closure mechanism 120 in a first stable position 124. Closure mechanism 120 is in an open-foot receiving configuration. In first stable position 124, second portion 120B is elongated, and extends away from outer edge 115 of midfoot portion 114B of sole 110 in a substantially perpendicular direction. Though shown in FIGS. 1 to 5 as extending away from the lateral side of article of footwear 100 in midfoot portion 114B, closure mechanism 120 may extend away from other portions of footwear 100, e.g., the medial side of footwear 100.

Figure 2A:
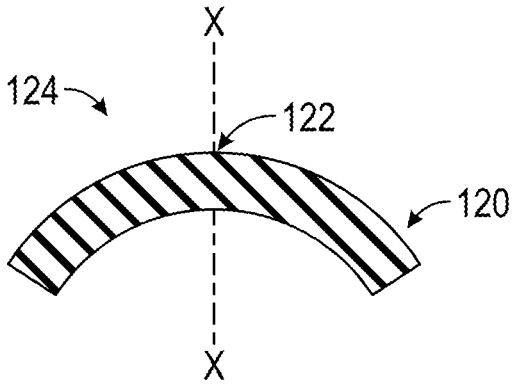
FIG. 2A is a cross-sectional view of the closure mechanism shown in FIG. 2, taken along line A-A.

FIG. 2A illustrates cross-section A-A of closure mechanism 120 in first stable position 124. In FIG. 2A, convex top surface 122 curves about axis X. Deformation of convex top surface 122 by trigger mechanism 130 releases closure mechanism 120 from first stable position 124 such that it rapidly and automatically wraps around a user's foot towards second stable position 126.

Figure 3:
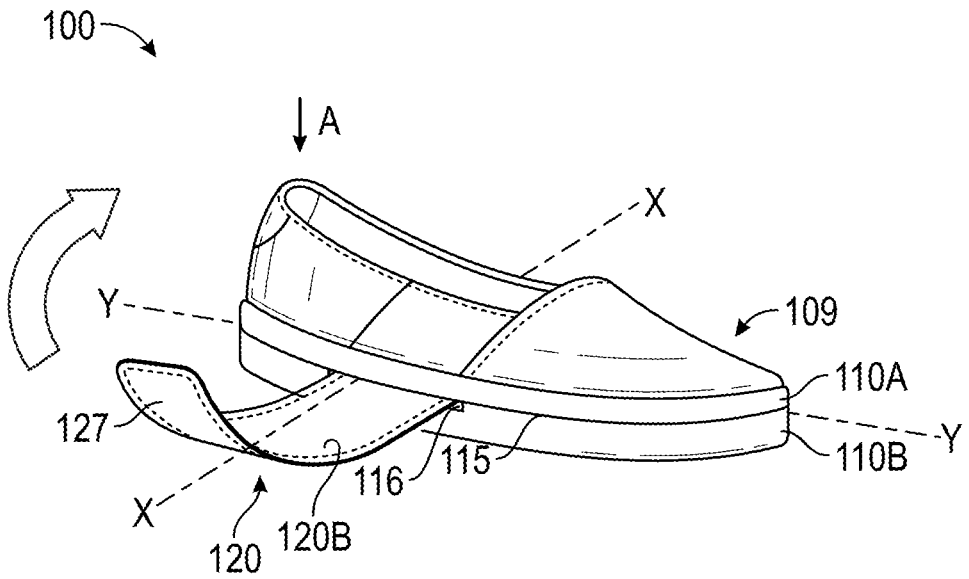
FIG. 3 is a perspective view of the article of footwear with the closure mechanism moving from the first stable position to a second stable position.

FIG. 3 illustrates article of footwear 100 after deformation of top surface 122 by downward force A. Second portion 120B of closure mechanism 120 is shown moving from first stable position 124 and automatically wrapping around an axis Y transverse to axis X and toward second stable position 126.

Figure 4:
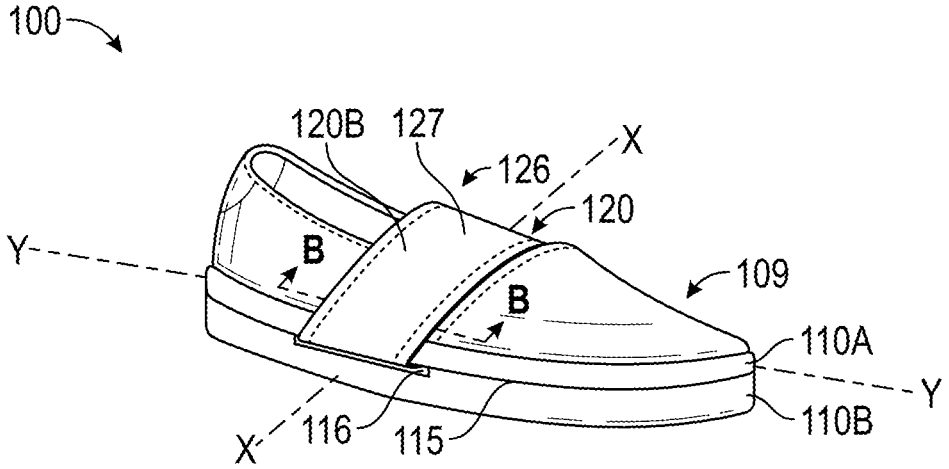
FIG. 4 is a perspective view of the article of footwear with the closure mechanism in the second stable position.

FIG. 4 illustrates article of footwear 100 with closure mechanism 120 in a second stable position 126. Second portion 120B is substantially arced, and wraps around a portion of upper shoe portion 109 of footwear 100.

Figure 4A:
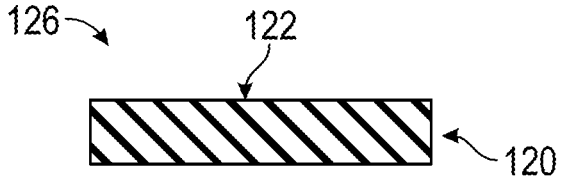
FIG. 4A is a cross-sectional view of the closure mechanism shown in FIG. 2, taken along line B-B.

FIG. 4A illustrates cross section B-B of closure mechanism 120 in second stable position 126, wherein top surface 122 is substantially flat.

Figure 5:
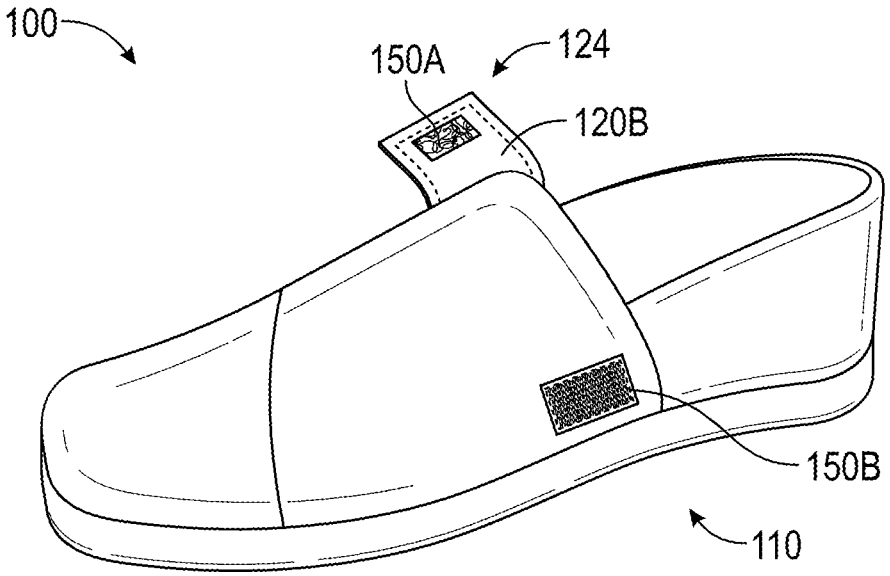
FIG. 5 is an opposing, perspective view of the article of footwear in the first stable position.

FIG. 5 illustrates an opposite view of article of footwear 100 with closure mechanism 120 in first stable position 124. Closure mechanism 120 includes a securing mechanism 150 having a first surface 150A that mates with a second surface 150B. First surface 150A is located on second portion 120B of closure mechanism 120. Second surface 150B is located on upper shoe portion 109 of article of footwear 100. In other embodiments, second surface 150B may be affixed to sole 110, or to an opposing closure mechanism. Securing mechanism 150 secures article of footwear 100 to a user's foot when closure mechanism 120 is in second stable position 126. While FIG. 5 shows securing mechanism 150 having two Velcro surfaces 150A and 150B that mate, it will be appreciated that other embodiments of securing mechanism 150 may include latches, zippers, press stud/snaps, mechanical loops, buttons, buckles, toggles, hook and eyes, and magnets so long as they are configured to secure article of footwear 100 to a user's foot.

In some embodiments, securing mechanism 150 may include specialized Polymagnets® or "Smart" magnets, including near field attachment magnets and/or rotate-release magnets. Near field attachment magnets may provide a safety benefit by limiting the radius of the magnetic field without affecting attachment strength. Rotate-release magnets that a user must turn to detach from footwear 100 may prevent unwanted loosening of closure mechanism 120.

Figure 6:
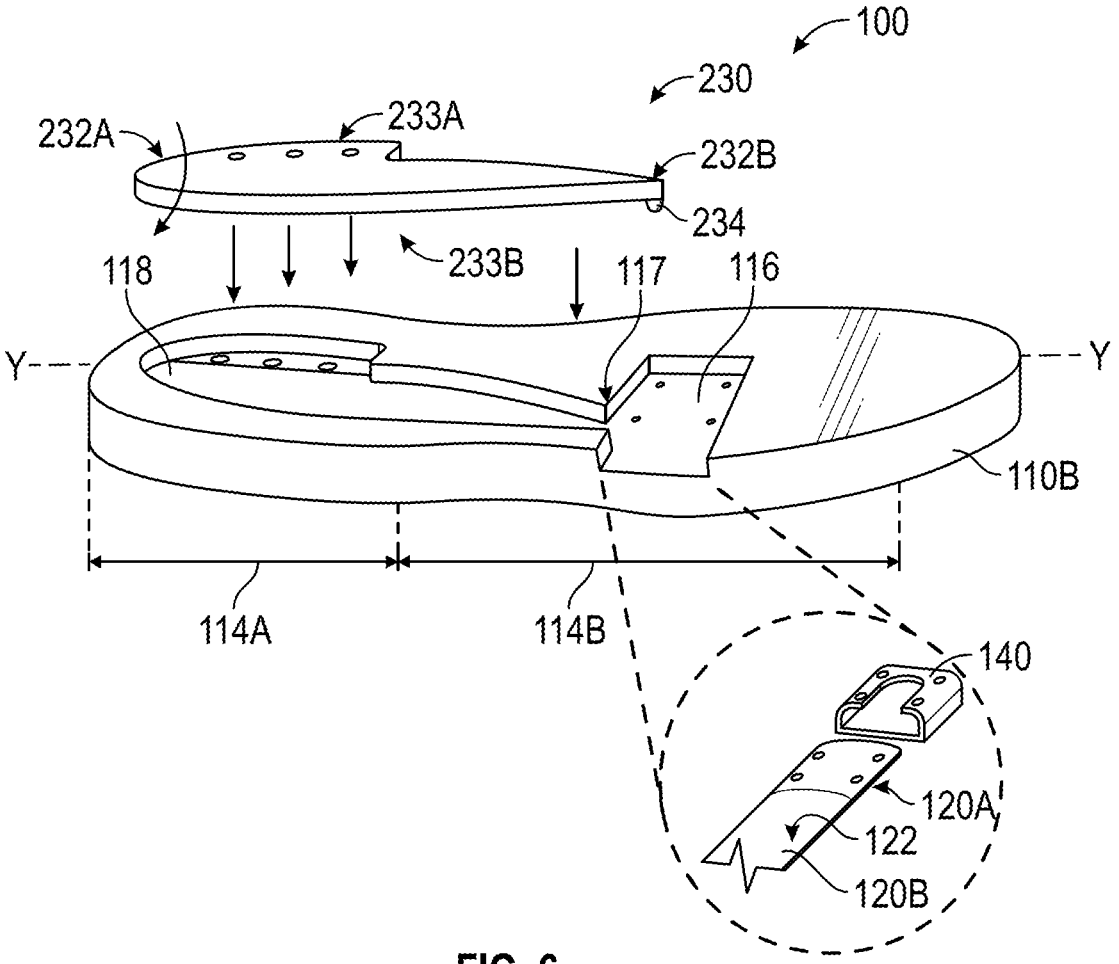
FIG. 6 is an exploded partial perspective view of a trigger mechanism, sole and closure mechanism, according to an example embodiment of the present invention.
Figure 7A:
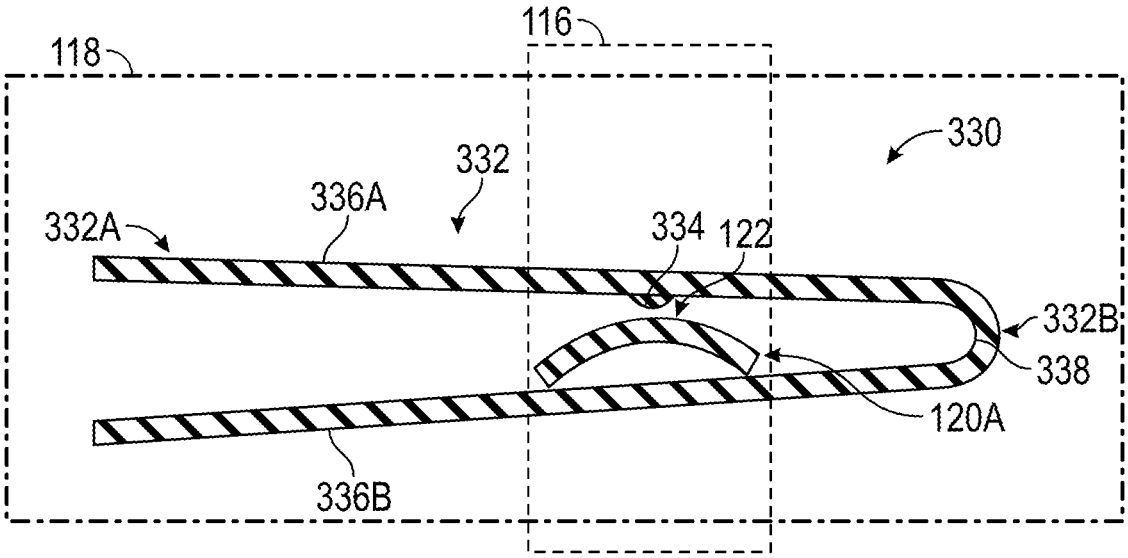
FIG. 7A is a cross-sectional view of a trigger mechanism, according to an example embodiment of the present invention.
Figure 7B:
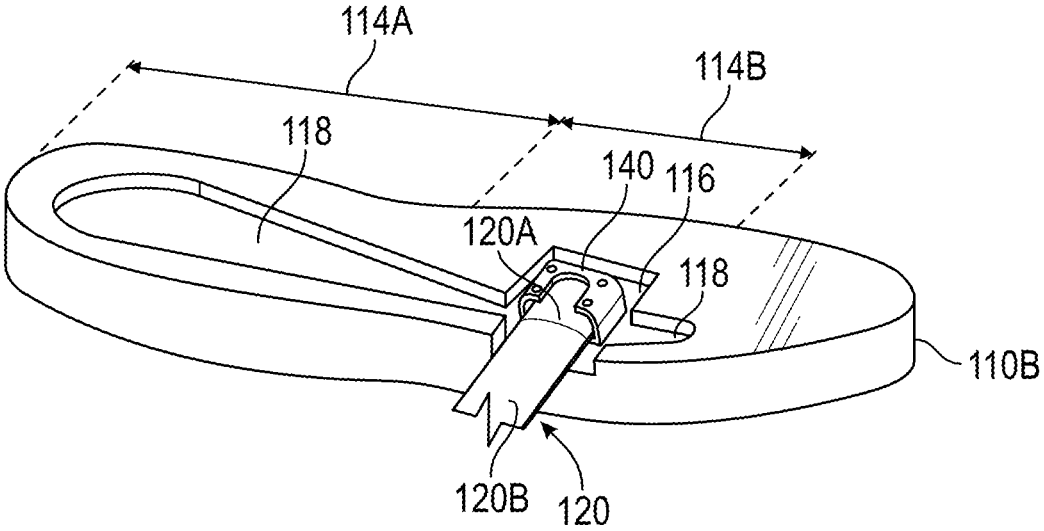
FIG. 7B is a perspective view of a sole and closure mechanism that can be used with the trigger mechanism shown in FIG. 7B.

FIGS. 6 to 8 illustrate different embodiments of trigger mechanisms that may be incorporated within second cavity 118 of footwear 100. Dimensions and arrangement of second cavity 118 may remain constant from heel portion 114A to midfoot portion 114B, or the width and height of second cavity 118 may vary depending on the configuration of trigger mechanisms, as discussed in more detail below.

FIG. 6 illustrates an exploded view of an embodiment of a trigger mechanism that can be incorporated into article of footwear 100. In this embodiment, trigger mechanism 230 includes a rigid member 232 with a first end 232A and a second end 232B. First end 232A extends within heel portion 114A of second cavity 118 in lower sole 110B. Second end 232B extends within midfoot portion 114B of second cavity 118 toward intersection 117 of first cavity 116 and second cavity 118. Second end 232B includes an application point 234 configured to extend into first cavity 116 and rest above convex top surface 122 of closure mechanism 120 in first stable position 124. Trigger mechanism 230 further includes a side portion 233A on the medial side of footwear 100, and a side portion 233B on the lateral side of footwear 100 extending the length of rigid member 232 from first end 232A to second end 232B. Side portion 233A of first end 232A is secured to heel portion 114A of second cavity 118 in a direction parallel to axis Y of sole 110. When receiving downward force A, lateral side portion 233B from first end 232A to second end 232B displaces downward into second cavity 118. A portion of second end 232B is configured to displace into first cavity 116 such that application point 234 deforms top surface 122 and activates second portion 120B of closure mechanism 120. While shown in FIG. 6 on the medial and lateral sides of footwear 100 respectively, side portions 233A and 233B are not limited to this configuration. Side portions 233A and 233B may have other arrangements so long as they permit application point 234 to deform top surface 122 and trigger closure of second portion 120B, e.g., side portions 233A and 233B may extend the length of trigger mechanism 230 on the lateral and medial sides of footwear 100, respectively.

FIG. 7 illustrates an embodiment of a trigger mechanism that can be incorporated into article of footwear 100. Trigger mechanism 330 includes a "tong-shaped" rigid member 332 having a first end 332A extending within heel portion 114A, and a second end 332B extending within midfoot portion 114B. Rigid member 332 has a top section 336A and a bottom section 336B that run the length of trigger mechanism 330 from first end 332A to second end 332B. Top section 336A and bottom section 336B of second end 332B extend into first cavity 116 and surround first portion 120A of closure mechanism 120. Top section 336A includes an application point 334 configured to rest above top surface 122 when footwear 100 is in first stable position 124. When a user's foot applies a downward force A to heel portion 114A of sole 110, bottom section 336B and top section 336A compress closure mechanism 120, causing application point 334 to deform top surface 122 and activate second portion 120B. While shown in FIG. 7 as "tong-shaped" with an activation point, trigger mechanism 330 may have other configurations so long as they clamp down and/or compress closure mechanism 120 to deform top surface 122 and activate second portion 120B. For example, the trigger mechanism may have two members connected by a hinge joint that clamp down on closure mechanism 120.

Figure 8A:
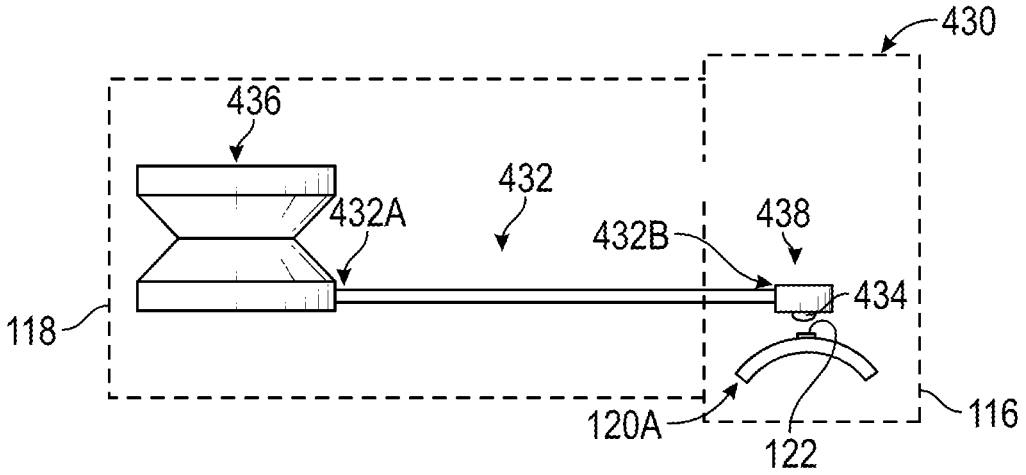
FIG. 8A is a side view of a trigger mechanism in a first position, according to an example embodiment of the present invention.
Figure 8B:
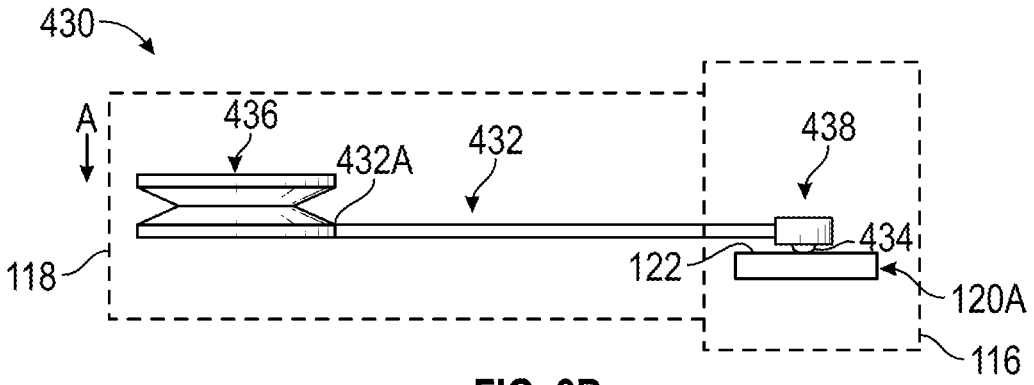
FIG. 8B is a side view of the trigger mechanism shown in FIG. 8A in a second position.
Figure 8C:
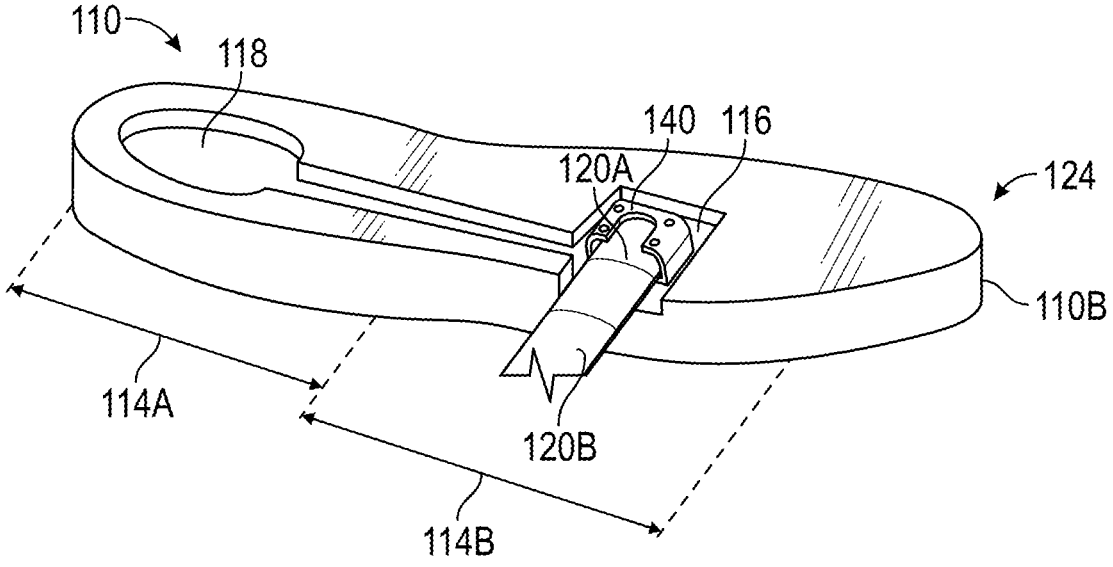
FIG. 8C is a perspective view of a sole that can be used with the trigger mechanism shown in FIG. 8A.

FIGS. 8A to 8C illustrate a pneumatic embodiment of a trigger mechanism that can be incorporated into article of footwear 100. Pneumatic trigger mechanism 430 includes an elongated rigid tube 432 extending through second cavity 118. Elongated rigid tube 432 includes a first end 432A attached to an air pump 436 in heel portion 114A, and a second end 432B attached to an inflatable material 438, e.g., a latex balloon, in midfoot portion 114B. Inflatable material 438 further includes an application point 434 affixed to an outside surface to aid in deforming top surface 122 of closure mechanism 120. As shown in FIG. 8B, when a user applies downward force A to heel portion 114A, air pump 436 compresses, displacing the air in pump 436 through rigid tube 432 and expanding inflatable material 438. A portion of inflatable material 438 is constrained from expanding by the configuration of cavities 116, 118 (or a firm or hard surface within the cavities), and upper sole 110A such that application point 434 is forced downward into first cavity 116, deforming top surface 122 of closure mechanism 120, and triggering movement from first stable position 124 to second stable position 126. While shown in FIG. 8A to 8C with a specific arrangement of pneumatic components, other pneumatic systems may be used so long as they have the critical features necessary to transfer downward force A such that it deforms convex top surface 122.

Figure 9A:
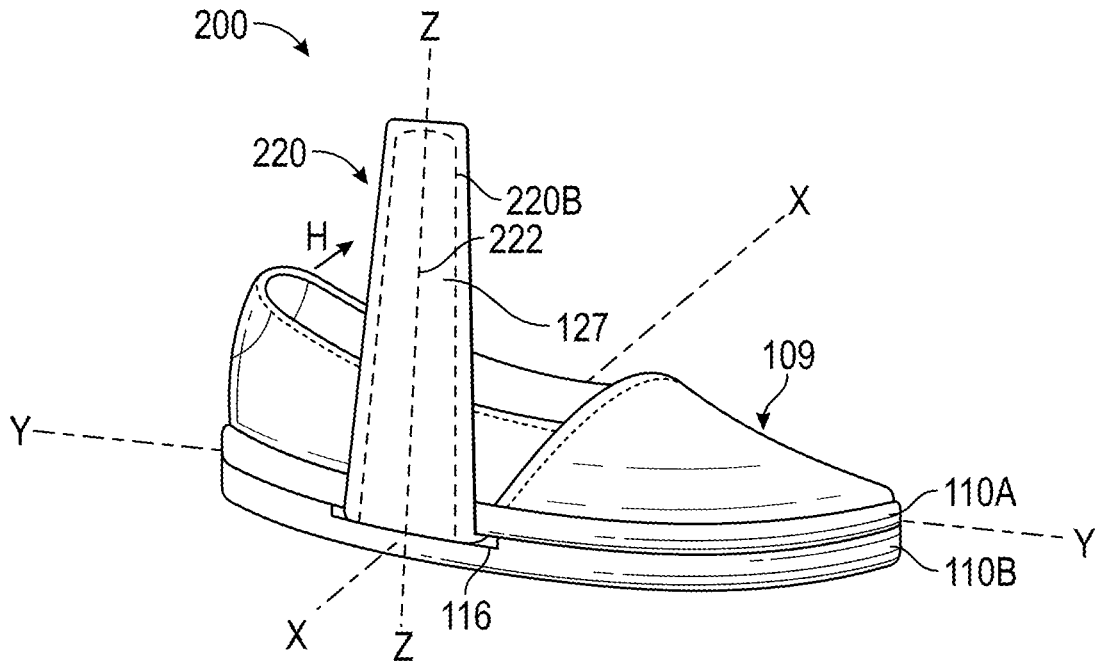
FIG. 9A is a perspective view of an article of footwear with a closure mechanism in a first stable position, according to an example embodiment of the present invention.
Figure 9B:
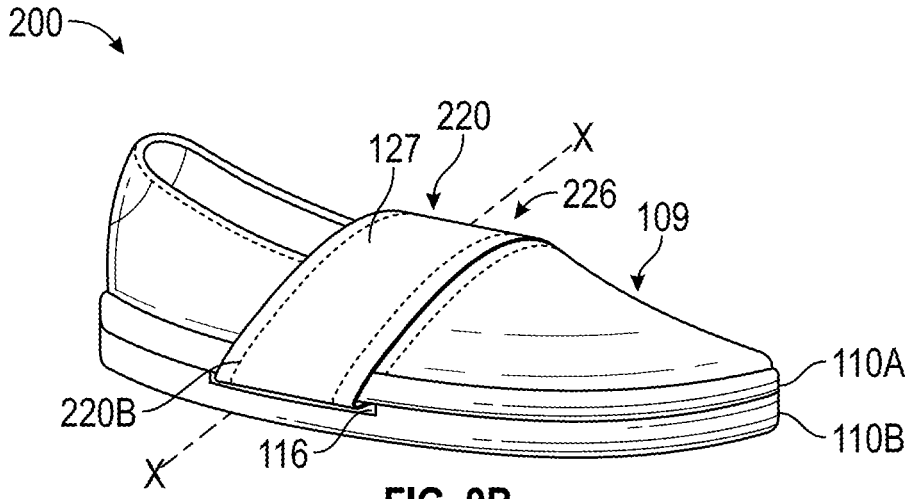
FIG. 9B is a perspective view of the article of footwear shown in FIG. 9A with the closure mechanism in a second stable position.

FIGS. 9A and 9B illustrate an article of footwear 200. Article of footwear 200 includes features of article of footwear 100, including upper shoe portion 109, sole 110, and enclosure 127. In this embodiment, lower sole 110B includes a single cavity 116. First portion 220A of closure mechanism 220 extends within cavity 116. As shown in FIG. 9A, second portion 220B of closure mechanism 220 extends away from sole 110 in a direction parallel to axis Z while in first stable position 224. Though shown parallel to axis Z in FIG. 9A, closure mechanism 220 may extend away from sole 110 in other directions, e.g., in a direction at an angle to axis Z while in first stable position 224, so long as second portion 220B wraps around a portion of a user's foot and/or upper shoe portion 109 upon actuation and provides functionality as described herein. In this embodiment, deforming top surface 222 and triggering closure mechanism 220 to shift from first stable position 224 to second stable position 226 requires application of a horizontal force H. Horizontal force H runs in a direction parallel to axis X. A user of article of footwear 200 can apply horizontal force H to deform top surface 222 by lightly slapping second portion 220B of closure mechanism 220 by hand. The horizontal force H applied by a user's hand triggers closure mechanism 220 to automatically shift from first stable position 224 and move toward second stable position 226. FIG. 9B shows article of footwear 200 in second stable position 226 after deformation of top surface 222. While article of footwear 200 is shown in FIGS. 9A and 9B without a mechanical, electrical, or pneumatic trigger mechanism, these trigger mechanisms may be included in article of footwear 200 so long as they have the critical features necessary to deform convex top surface 222 of closure mechanism 220.

Figure 10A:
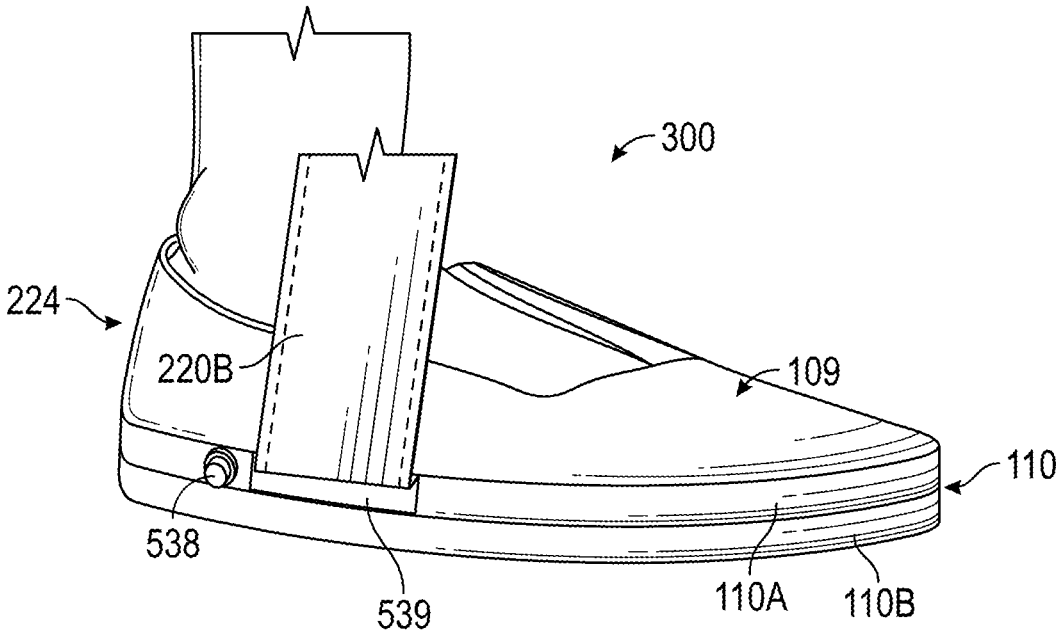
FIG. 10A is a perspective view of an article of footwear with a trigger mechanism and a closure mechanism in a first stable position, according to an example embodiment of the present invention.
Figure 10B:
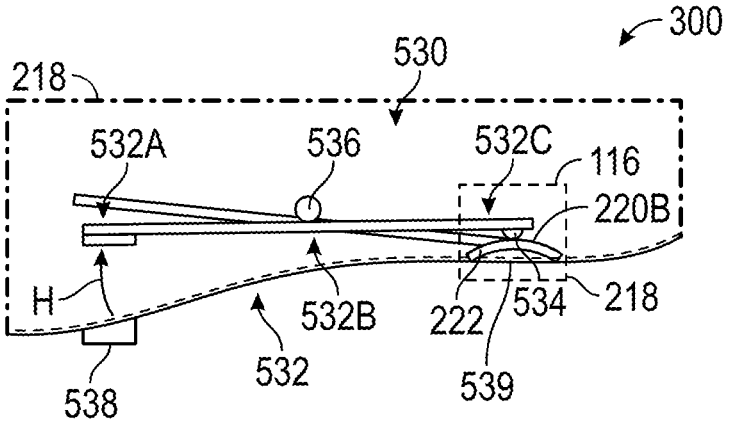
FIG. 10B is a partial perspective view of the trigger mechanism shown in FIG. 10A.

FIGS. 10A and 10B illustrate an article of footwear 300. Article of footwear 300 may include features of soles, trigger mechanisms, enclosures, sleeves, and securing mechanisms discussed herein. In FIG. 10A, article of footwear 300 includes closure mechanism 220 in first stable position 224. Footwear 300 has an exterior button 538 configured to interface with a trigger mechanism 530. As shown in FIG. 10B, trigger mechanism 530 includes a rigid member 532. Rigid member 532 extends within a second cavity 218 in lower sole 110B. Second cavity 218 extends across a portion of length 112A in midfoot portion 114B toward first cavity 116. Rigid member 532 includes a first end 532A, a center portion 532B, and a second end 532C. First end 532A connects to exterior button 538. Center portion 532B interfaces with a pivot rod 536. Pivot rod 536 secures to sole 110 in midfoot portion 114B. Second end 532C of rigid member 532 includes an application point 534. Application point 534 rests adjacent to convex top surface 222 of closure mechanism 220 when in first stable position 224. Footwear 300 further includes a rigid surface 539. Rigid surface 539 extends within second cavity 218 such that second end 532B and rigid surface 539 and effectively "sandwich" closure mechanism 220. When a user applies horizontal force H to exterior button 538, rigid member 532 pivots around pivot rod 536 at center portion 532B. The opposing forces supplied by rigid surface 539 and application point 534 compress and deform convex top surface 222, triggering closure mechanism 220 to move from first stable position 224 to second stable position 226. Though shown in FIGS. 10A and 10B as extending from the medial side of article of footwear 300 in midfoot portion 114B, closure mechanism 220 may extend from other parts of footwear 300, e.g., the lateral side of footwear 300. Other features of articles of footwear 100 and 200, including sleeves, enclosures, and securing mechanisms, may be incorporated into article of footwear 300.

Figure 11A:
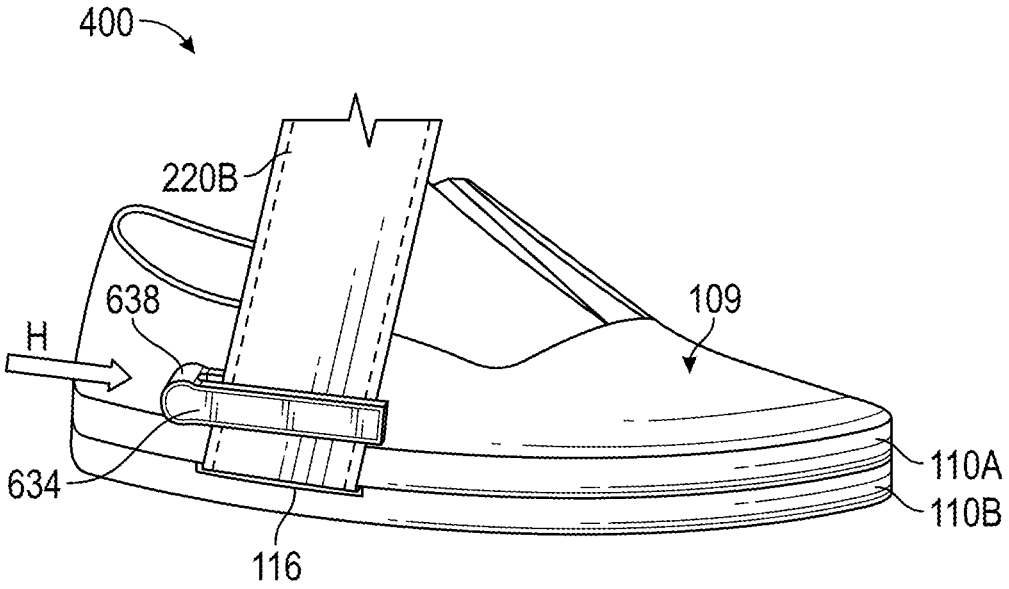
FIG. 11A is a perspective view of an article of footwear with a closure mechanism in a first stable position, according to an example embodiment of the present invention.
Figure 11B:
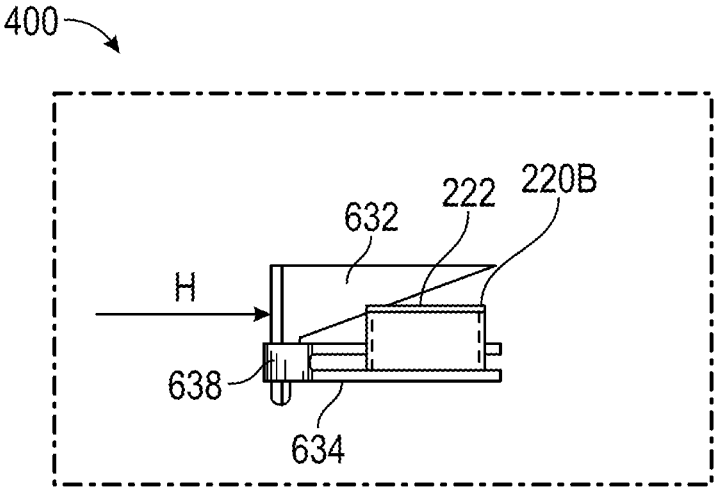
FIG. 11B is a top view of the article of footwear shown in FIG. 11A.

FIGS. 11A and 11B illustrate an article of footwear 400. Article of footwear 400 may include features of soles, trigger mechanisms, enclosures, sleeves, and securing mechanisms discussed herein. In FIG. 11A, article of footwear 400 includes closure mechanism 220 in first stable position 224. As shown in FIGS. 11A and 11B, article of footwear 400 includes a trigger mechanism 630 and an opening 219. Opening 219 extends along a portion of length 112A of midfoot portion 114B and runs through outer edge 115 to second cavity 218 in lower sole 110B. Trigger mechanism 630 includes a wedge 632, a rigid bar 638, and an exterior sliding bar 634. Wedge 632 extends within second cavity 218 in midfoot portion 114B. Wedge 632 includes an angled surface 632A, a center point 632B, and a flat end 632C. Flat end 632C attaches to rigid bar 638. Rigid bar 638 extends through channel 219 and attaches to exterior sliding bar 634. Exterior sliding bar 634, rigid bar 638, and wedge 632 are configured to slide along opening 219 toward closure mechanism 220 when a user applies horizontal force H to exterior sliding bar 634 in a direction parallel to axis Y. Center point 632B of angled surface 632A and exterior sliding bar 634 are configured to compress and deform top surface 222 of closure mechanism 220. Deformation of top surface 222 triggers closure mechanism 220 to automatically and rapidly shift from first stable position 224 to second stable position 226 and secure article of footwear 400 to a user's foot. Though shown in FIGS. 11A and 11B as extending from the lateral side of article of footwear 400 in midfoot portion 114B, closure mechanism 220 may extend from other parts of footwear 400, e.g., the medial side of footwear 400. Other features of articles of footwear 100, 200, and 300, including sleeves, enclosures, and securing mechanisms, may be incorporated into article of footwear 400.

Figure 12A:
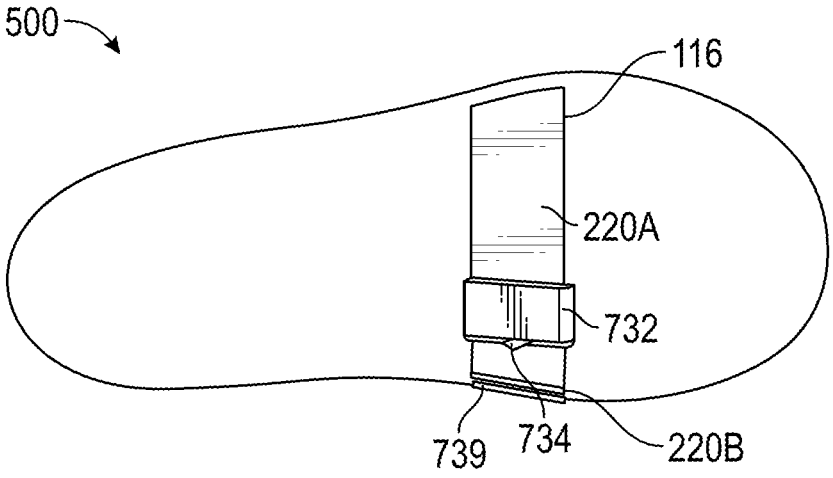
FIG. 12A is a top view of an article of footwear with a trigger mechanism, according to an example embodiment of the present invention.
Figure 12B:
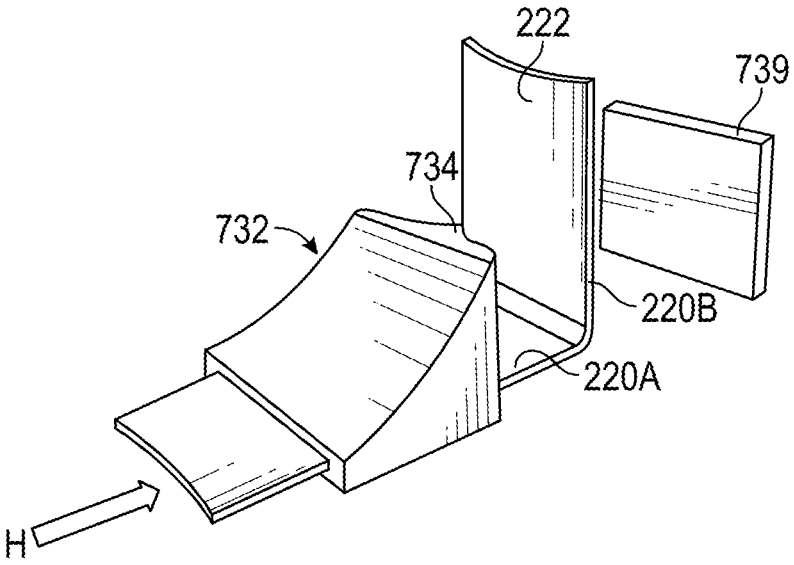
FIG. 12B is a partial perspective view of the trigger mechanism shown in FIG. 12A.

FIG. 12 illustrates an article of footwear 500. Article of footwear 500 may include features of soles, trigger mechanisms, enclosures, sleeves, and securing mechanisms discussed herein. In FIG. 11A, article of footwear 500 includes closure mechanism 220 in first stable position 224. Article of footwear 500 includes a trigger mechanism 730. Trigger mechanism 730 includes a wedge 732 having an application point 734, and a rigid surface 739. When a user inserts a foot into footwear 500 and applies downward force A, wedge 732 slides toward closure mechanism 220. Application point 734 and rigid surface 739 are configured to compress top surface 222 of closure mechanism 220, deforming top surface 222 and triggering closure mechanism 220 to automatically shift from first stable position 224 to second stable position 226. Trigger mechanism 730 may extend within second cavity 118, and/or across upper sole 110A, provided that it is configured to receive downward force A and transfer it such that it deforms top surface 222 of closure mechanism 220.

Figure 13A:
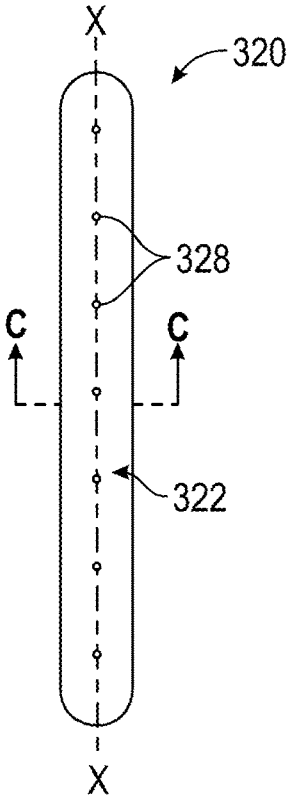
FIG. 13A is a top view of a closure mechanism, according to an example embodiment of the present invention.
Figure 13B:
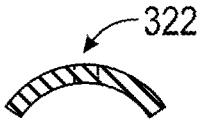
FIG. 13B is a cross-sectional view of the closure mechanism in FIG. 13A, taken along line C-C.
Figure 14:
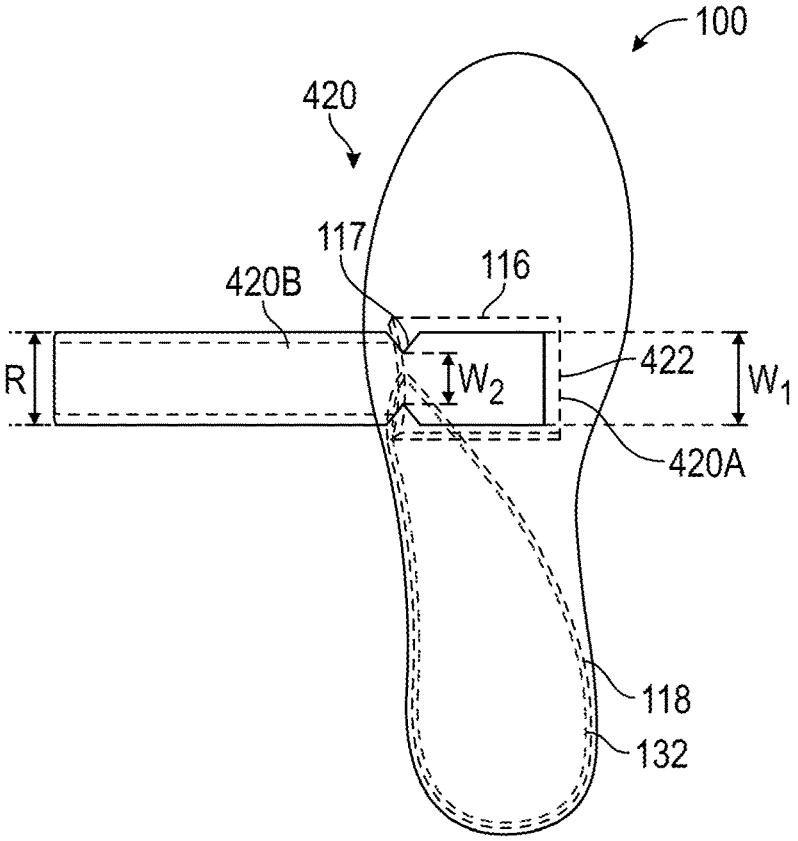
FIG. 14 is a top view of a closure mechanism on a sole, according to an example embodiment of the present invention.

FIGS. 13 to 14 illustrate embodiments of closure mechanisms that may be used in articles of footwear as discussed herein. As shown in FIGS. 13 to 14, modifications to closure mechanisms discussed herein may be made that alter strength, flexibility, arc shape, and closure rate of closure mechanisms. Modified closure mechanisms may be used in conjunction with soles, trigger mechanisms, sleeves, and securing mechanisms discussed herein.

FIG. 13A illustrates a closure mechanism 320 that can be used in articles of footwear as discussed herein. FIG. 13B illustrates cross-section C-C of closure mechanism 320 in first stable position 124. Closure mechanism 320 includes a multitude of holes 328 positioned on top surface 322 along axis X. Holes 328 may interrupt and/or delay the movement of closure mechanism 320 from first stable position 124 to second stable position 126 depending on the thickness of closure mechanism 320 and configuration of holes 328. Thickness may range from approximately 0.1 mm to approximately 0.5 mm. As thickness increases, the strength and closure rate of closure mechanism 320 may increase, flexibility may decrease, and the effect of holes 328 on closure mechanism strength, flexibility, and closure rate may decrease. The extent of the decreased effect may vary depending on the thickness of closure mechanism 320, diameter of holes 328, distance between holes 328 and top surface 322, distance between holes 328, and quantity of holes 328 on closure mechanism 320. For example, a single hole positioned on a top surface of a closure mechanism with a thickness of approximately 0.14 mm interrupts the movement of the closure mechanism from a first stable position to a second stable position such that an intermediate stable position is created. However, a single hole on a top surface of a closure mechanism with a thickness of approximately 0.24 mm delays, but does not interrupt, the movement of the closure mechanism from a first stable position to a second stable position.

FIG. 14 illustrates a closure mechanism 420 that may be used in articles of footwear as discussed herein. As shown in FIG. 14, closure mechanism 420 includes a first portion 420A, a second portion 420B, and a top surface 422 with a width $W_1$ and a width $W_2$. The width of top surface 422 directly correlates to the degree of downward force A required to deform top surface 422. Closure mechanisms with smaller widths require less downward force to deform than closure mechanisms with larger widths, provided that closure mechanisms are of the same thickness. In FIG. 14, closure mechanism 420 is configured such that width $W_1$ of top surface 422 decreases to width $W_2$ at intersection 117 between first cavity 116 and second cavity 118. Application point 134 of trigger mechanism 130 is configured to deform top surface 422 of closure mechanism 420 at width $W_2$ upon application of downward force A. Because less downward force A is required to deform top surface 422 at $W_2$ than at $W_1$, this embodiment enables light weight users of articles of footwear described herein to successfully actuate closure mechanism 420 without reducing the thickness and/or overall strength of closure mechanism 420. While shown in FIG. 14 as having one location with reduced width $W_2$, it will be appreciated that closure mechanism 420 is not limited to this arrangement. In other embodiments of closure mechanism 420, widths $W_1$ and $W_2$ may alternate along second portion 420B to optimize the strength of closure mechanism 420 while maximizing flexibility.

Closure mechanisms discussed herein may include coatings that enable the closure mechanisms to automatically reopen to respective first stable positions, e.g., piezoelectric polymers, ferroelectric polymers, and/or memory wire. The coatings may be used in conjunction with sensors and/or electronic actuators that, when triggered, emit an electrical current. The electrical current may be configured to cause closure mechanisms discussed herein to automatically shift from their respective second stable positions back to first stable positions. Sensors that may be incorporated into closure mechanisms discussed herein include photo sensors, pressure sensors, strain gauges, and/or vibration sensors.

Figure 15A:
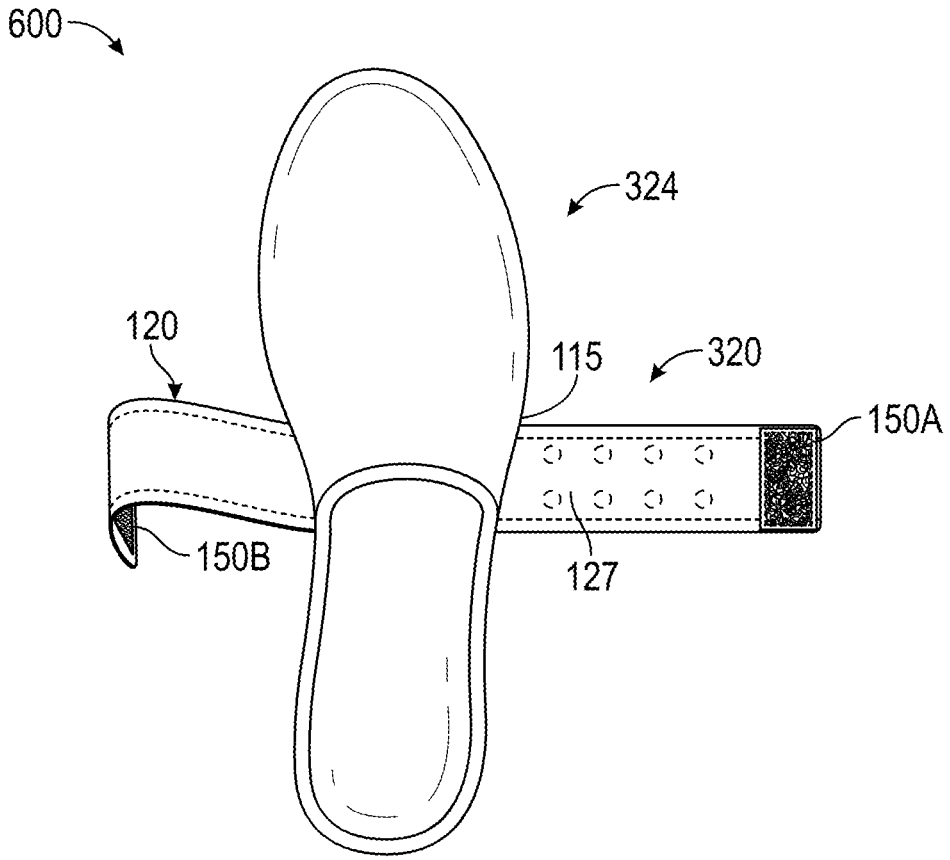
FIG. 15A is a top view of an article of footwear with a closure mechanisms in a first stable position, according to an example embodiment of the present invention.
Figure 15B:
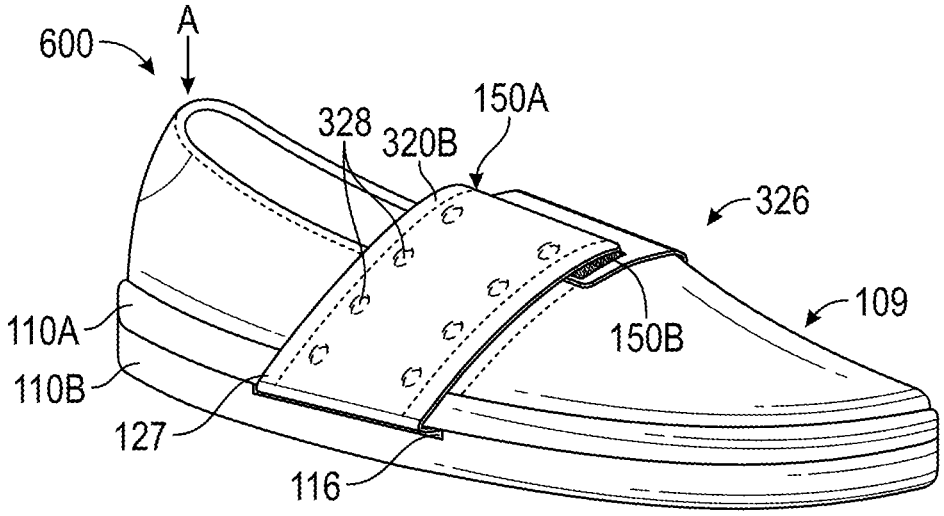
FIG. 15B is a perspective view of the article of footwear shown in FIG. 12A with the closure mechanisms in a second stable position.

FIGS. 15A and 15B illustrate an article of footwear 600. Article of footwear 600 may include features of soles, trigger mechanisms, sleeves, and securing mechanisms discussed herein. As shown in FIG. 15A, article of footwear 600 includes a first closure mechanism 120 and a second closure mechanism 320. In this embodiment, first cavity 116 extends the full width 112B of lower sole 110B. First portion 120A of closure mechanism 120 and first portion 320A of second closure mechanism 320 extend within first cavity 116 on the medial side and lateral sides of sole 110. In first stable position 324, second portions 120B and 320B extend away from sole 110 in a direction substantially perpendicular to outer edge 115. While shown in FIG. 15A as perpendicular to outer edge 115, second portions 120B and 320B can extend away from outer edge 115 in other directions, e.g., in a direction at an angle to outer edge 115, so long as section portions 120B and 320B wrap around a portion of a user's foot and/or upper shoe portion 109 upon actuation, and provide functionality as described herein.

As shown in FIGS. 15A and 15B, second portions 120B and 320B of closure mechanisms 120 and 320 include first surface 150A and second surface 150B of securing mechanism 150, respectively, that mate when in second stable position 326. Second closure mechanism 320 includes a multitude of holes 328. When first closure mechanism 120 and second closure mechanism 320 are triggered, holes 328 decrease the closure rate of second closure mechanism 320, causing second portions 320B and 120B to move towards second stable position 326 at different speeds. The different speeds allow second closure mechanism 320 to consistently overlap first closure mechanism 120 when in second stable position 326, thereby enabling first surface 150A and second surface 150B of securing mechanism 150 to mate and secure article of footwear 600 to a user's foot.

Figure 16A:
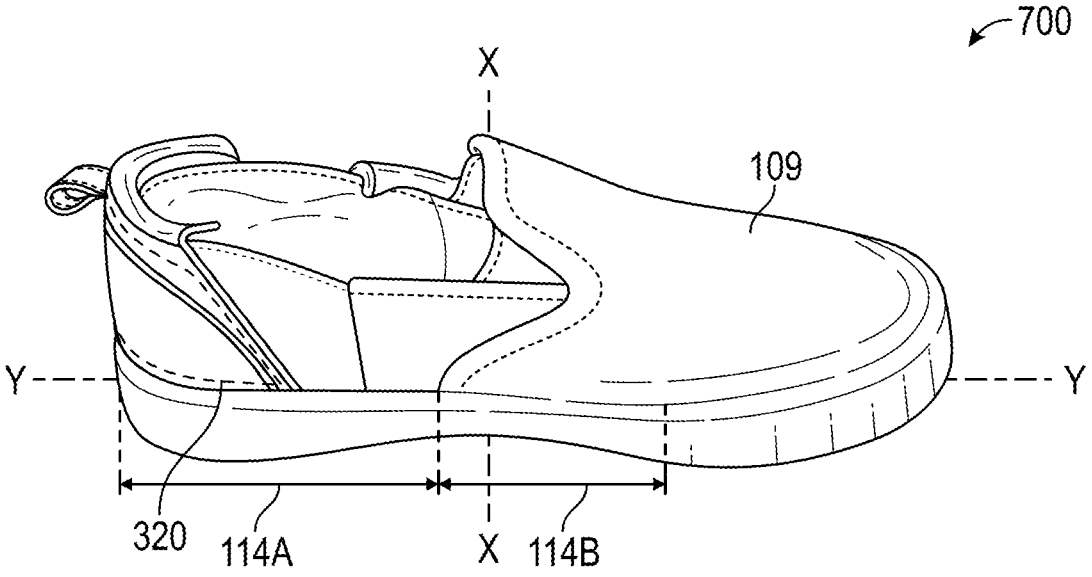
FIG. 16A is a perspective view of an article of footwear, according to an example embodiment of the present invention.
Figure 16B:
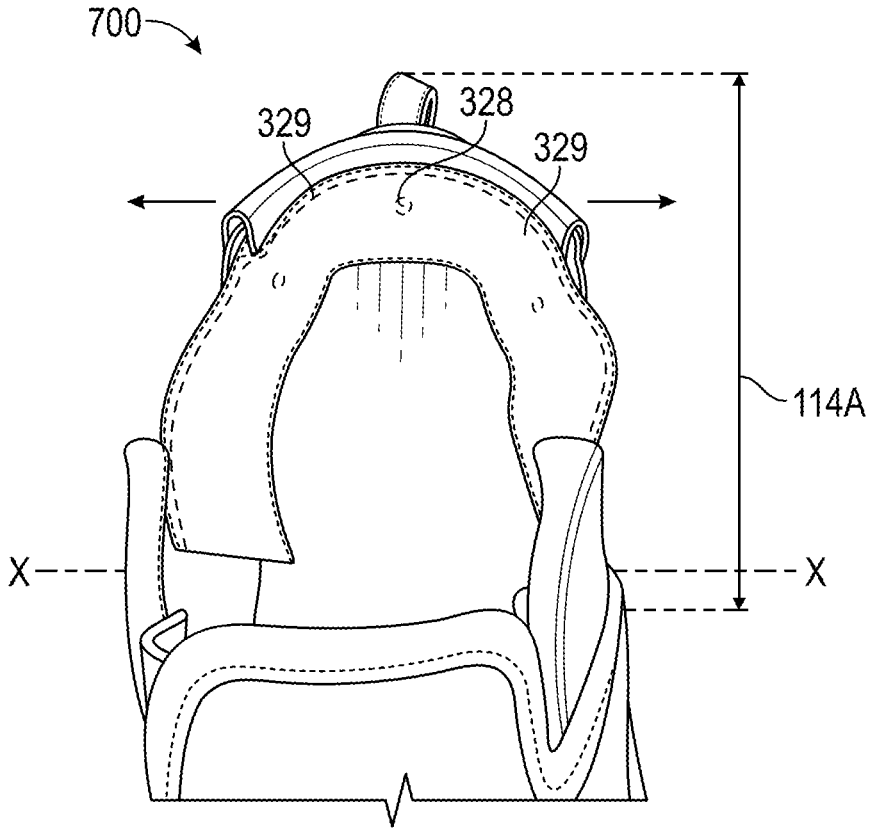
FIG. 16B is a partial perspective view of the article of footwear shown in FIG. 16A.
Figure 16C:
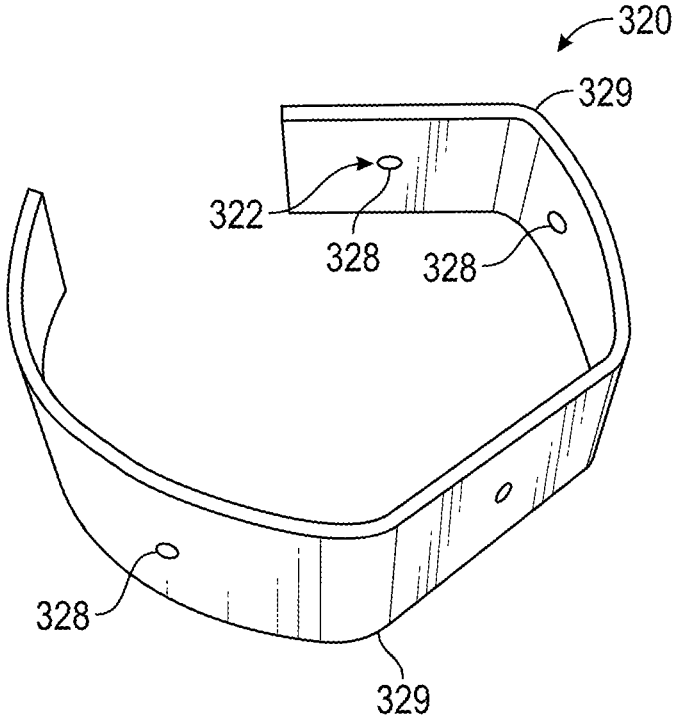
FIG. 16C is a perspective view of a closure mechanism, according to an example embodiment of the present invention.

FIGS. 16A to 16C illustrate an article of footwear 700. Article of footwear 700 may include features of soles, trigger mechanisms, sleeves, and securing mechanisms discussed herein. As shown in FIG. 16C, article of footwear 700 includes closure mechanism 320 having holes 328 located on top surface 322. As shown in FIGS. 16A and 16B, closure mechanism 320 is integrated into upper shoe portion 109 in heel portion 114A. In this embodiment, closure mechanism 320 has a thickness of approximately 0.14 mm, however closure mechanism 320 is not limited to this thickness, so long as closure mechanism 320 provides functionality as described herein. At the center point between each hole 328, closure mechanism 320 has an inflection point 329. An inflection point is any point at which there is a change in the direction of the curvature of closure mechanism 320, and/or any location where closure mechanism 320 has a minimal or low stress state and may maintain an intermediate stable structure. In FIGS. 16A to 16C, holes 328 and inflection points 329 allow a user of article of footwear 700 to expand and contract the opening of the footwear in a direction parallel to axis X, easing the insertion of a user's foot into footwear 700. While shown integrated into upper shoe portion 109 in heel portion 114A in FIGS. 16A to 16C, closure mechanism 320 may be integrated into other portions of article of footwear 700 so as to ease the insertion of a foot into footwear 700.

FIGS. 17 to 19 illustrate articles of footwear 800 to 1000. Articles of footwear 800 to 1000 may include features of soles, closure mechanisms, trigger mechanisms, sleeves, enclosures, and securing mechanisms discussed herein. However, the dimensions of cavities 116 and 118 may vary depending on the arrangement and configuration of closure mechanisms and trigger mechanisms incorporated into articles of footwear 800 to 1000.

Figure 17A:
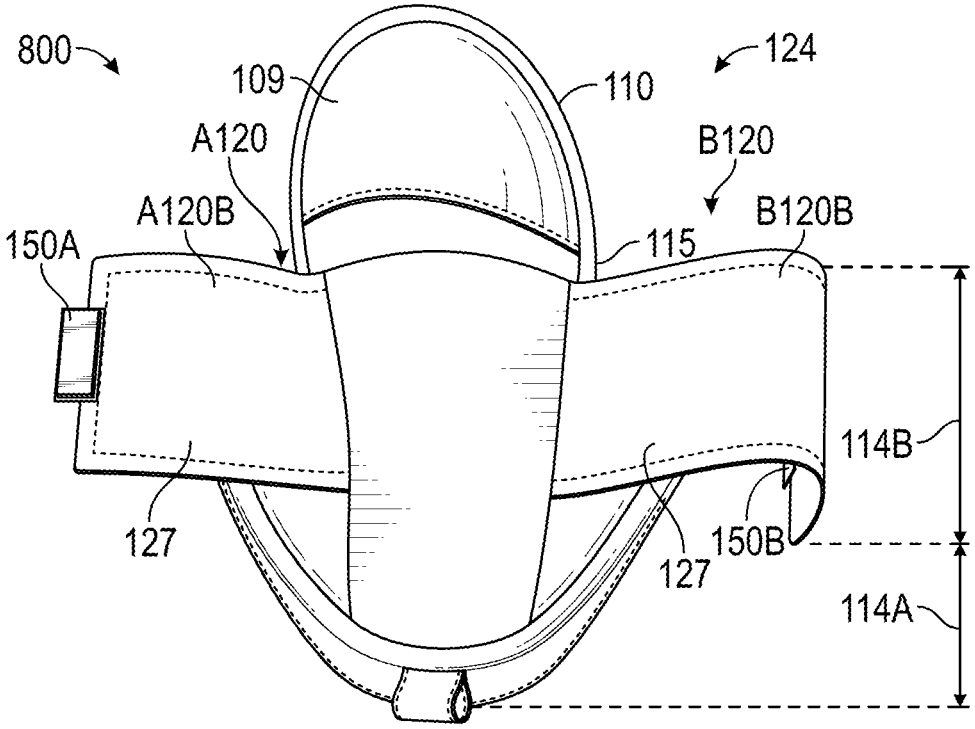
FIG. 17A is a perspective view of an article of footwear with a closure mechanism in a first stable position, according to an example embodiment of the present invention.
Figure 17B:
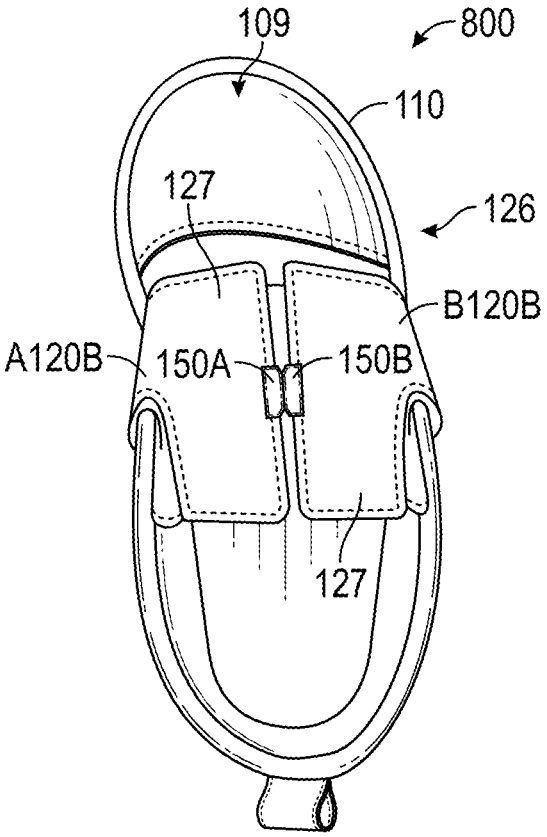
FIG. 17B is a perspective view of the article of footwear shown in FIG. 17A with the closure mechanism in a second stable position.

FIGS. 17A to 17B illustrate article of footwear 800. Article of footwear 800 includes two closure mechanisms, A120 and B120, in first stable position 124. As shown in FIG. 17A, closure mechanisms A120 and B120 extend outward from both the medial and lateral sides of midfoot portion 114B of sole 110 in a direction substantially perpendicular to outer edge 115, though in other embodiments, second portion 620B may extend away from sole 110 in a direction at an angle to outer edge 115. Closure mechanisms A120 and B120 are configured within fabric enclosure 127 such that they widen the opening of footwear 800 when in first stable position 124 to enable a user to more easily insert a foot. FIG. 17B illustrates opposing closure mechanisms A120 and B120 in second stable position 126. As shown, first surface 150A and second surface 150B of securing mechanism 150 attach to second portion A120B and second portion B120B, respectively. While FIGS. 17A to 17B show article of footwear 800 with opposing closure mechanisms A120 and B120, it will be appreciated that article of footwear 800 is not limited to this configuration. In other embodiments, additional closure mechanisms may be included, e.g., a multitude of adjacent closure mechanisms may be included, so long as they provide the functionality described herein.

Figure 18A:
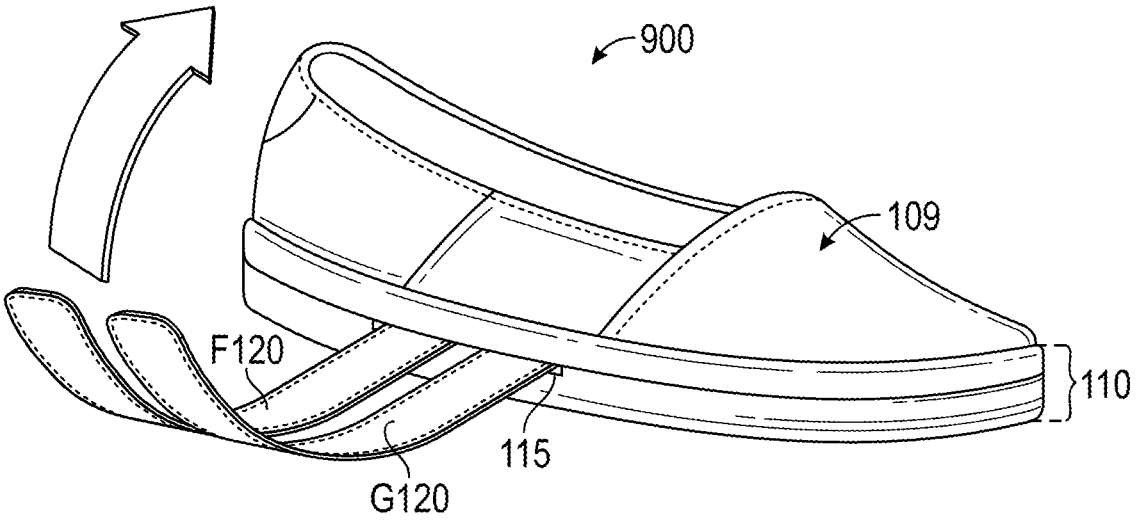
FIG. 18A is a perspective view of an article of footwear with a closure mechanisms in a first stable position, according to an example embodiment of the present invention.
Figure 18B:
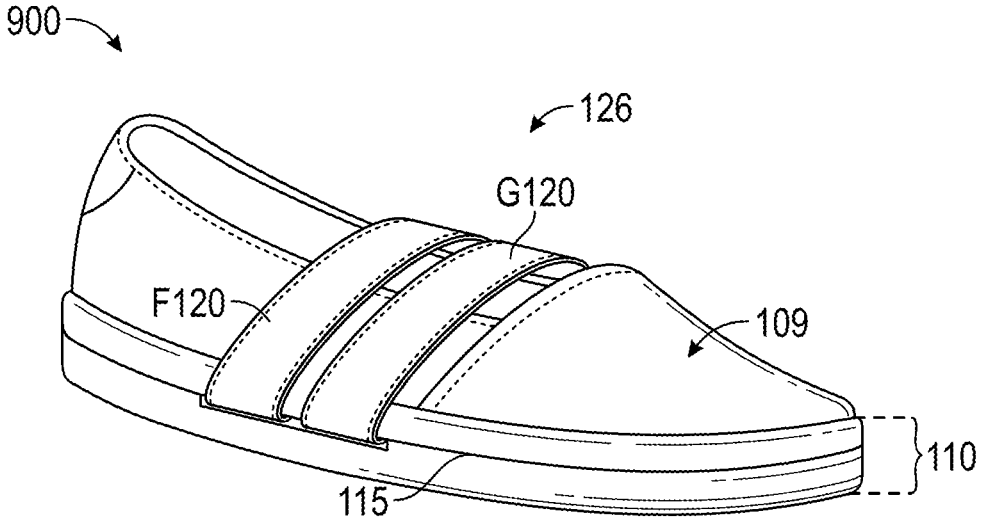
FIG. 18B is a perspective view of the article of footwear shown in FIG. 18A with the closure mechanisms in a second stable position.

FIGS. 18A to 18B illustrate article of footwear 900. As shown in FIGS. 18A and 18B, article of footwear 900 includes two adjacent closure mechanisms, F120 and G120, in first stable position 124 and second stable position 126, respectively. While not shown in FIGS. 18A and 18B, footwear 900 may include any of trigger mechanisms 130 to 430, soles, enclosures, sleeves, and securing mechanisms as discussed herein, so long as they are arranged such that downward force A from a user of the footwear is transferred to and deforms top surfaces F122 and G122 of adjacent closure mechanisms F120 and G120.

Figure 19A:
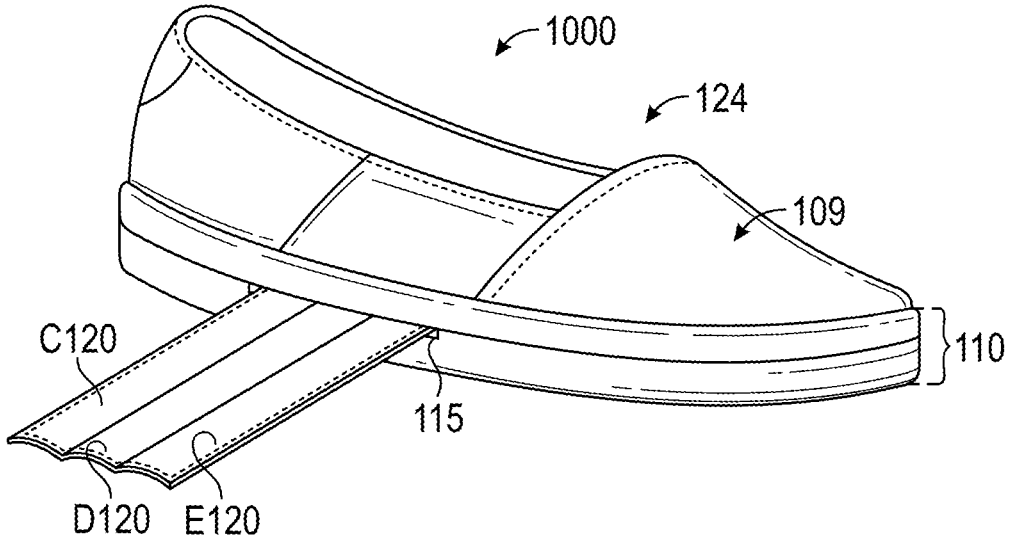
FIG. 19A is a perspective view of an article of footwear with a closure mechanisms in a first stable position, according to an example embodiment of the present invention.
Figure 19B:
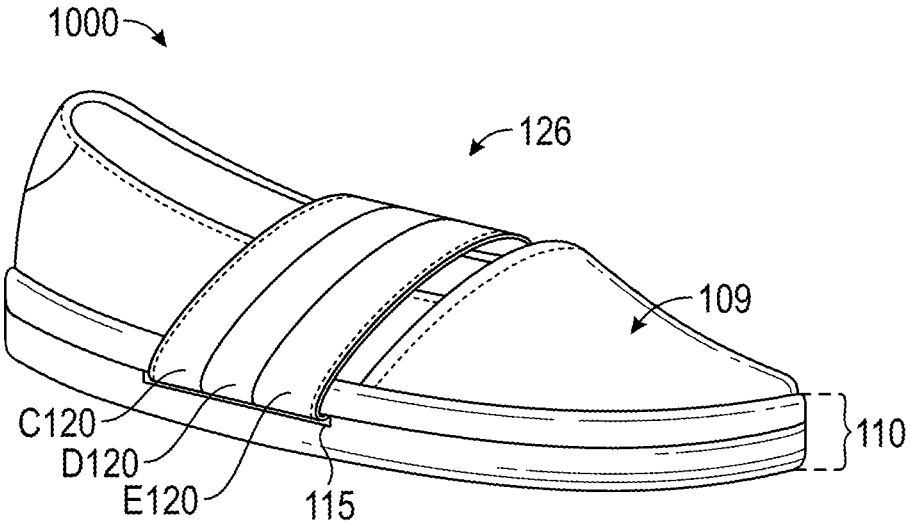
FIG. 19B is a perspective view of the article of footwear shown in FIG. 19A with the closure mechanisms in a second stable position.

FIG. 19A to 19B illustrate article of footwear 1000. Article of footwear 1000 includes three adjacent closure mechanisms, C120, D120, and E120, in first stable position 124 and second stable position 126, respectively. The adjacent closure mechanisms may be configured to operate as a single unit, effectively expanding the width of closure mechanisms without increasing the curvature of convex top surface 122. While not shown in FIGS. 19A and 19B, footwear 1000 may include any of trigger mechanisms 130 to 430, and/or soles, enclosures, sleeves, and securing mechanisms as discussed herein, so long as they are arranged such that downward force A from a user of footwear 1000 is transferred to and deforms top surfaces C122, D122, and E122 of adjacent closure mechanisms C120, D120, and E120. Though shown substantially perpendicular to outer edge 115, in other embodiments, closure mechanisms discussed herein may extend away from sole 110 in a direction at an angle to outer edge 115.

FIGS. 20A and 20B, 21A and 21B, and 22A and 22B illustrate articles of footwear 1100 to 1300 in first stable position 124 and second stable position 126, respectively. Articles of footwear 1100 to 1300 include features of sandals, flip flops, and other open-toed types of footwear. Articles of footwear 1100 to 1300 may include any number and/or combination of soles, closure mechanisms, trigger mechanisms, sleeves, enclosures, and securing mechanisms as discussed herein, so long as the components are configured such that the article of footwear automatically shifts from first stable position 124 to second stable position 126 when a user applies downward force A and/or a horizontal force H to the footwear.

Figure 20A:
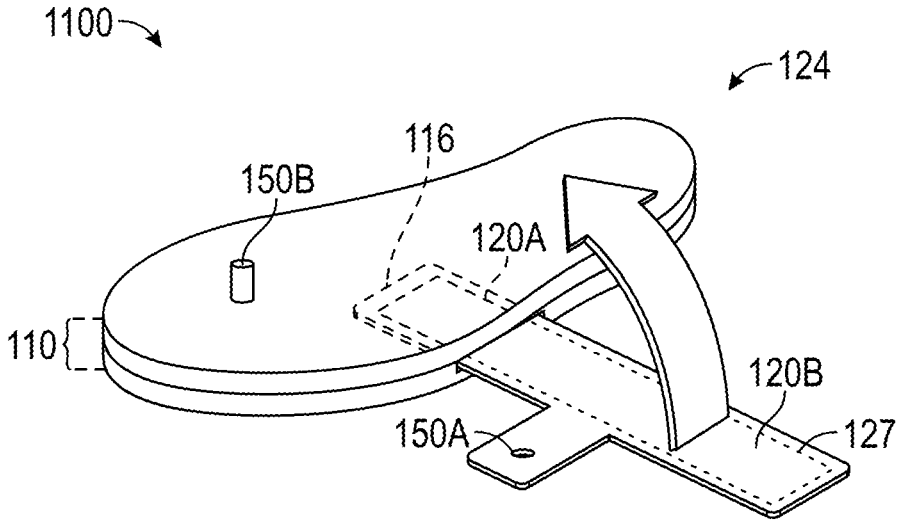
FIG. 20A is a perspective view of an article of footwear with a closure mechanism in a first stable position, according to an example embodiment of the present invention.
Figure 20B:
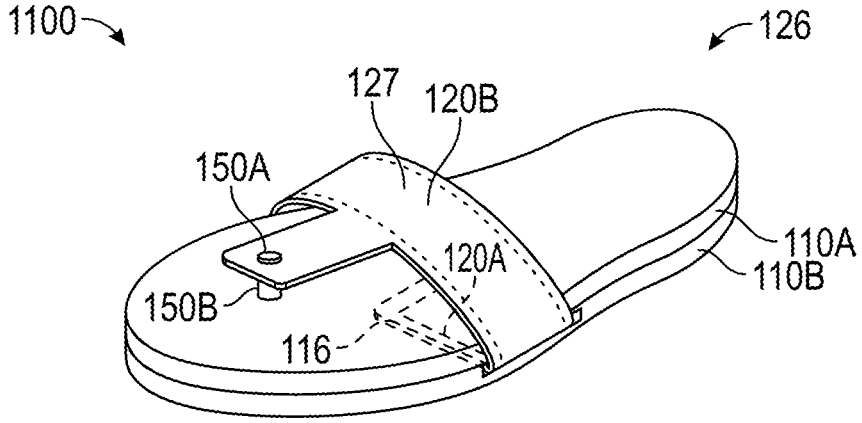
FIG. 20B is a perspective view of the article of footwear shown in FIG. 20A with the closure mechanism in a second stable position.

FIGS. 20A and 20B illustrate article of footwear 1100. As shown in FIG. 20A, article of footwear 1100 includes sole 110, closure mechanism 120, enclosure 127, and securing mechanism 150. Second portion 120B of closure mechanism 120 includes first surface 150A of securing mechanism 150. Sole 110 includes second surface 150B of securing mechanism 150. As shown in FIG. 20B, first surface 150A and second surface 150B of securing mechanism 150 mate to secure article of footwear 1100 to a user's foot when in second stable position 126. While not shown in FIGS. 20A and 20B, article of footwear 1100 may include any of trigger mechanisms 130 to 430 described herein, provided they are configured to act on and/or actuate closure mechanism 120 upon application of downward force A to heel portion 114A of sole 110.

Figure 21A:
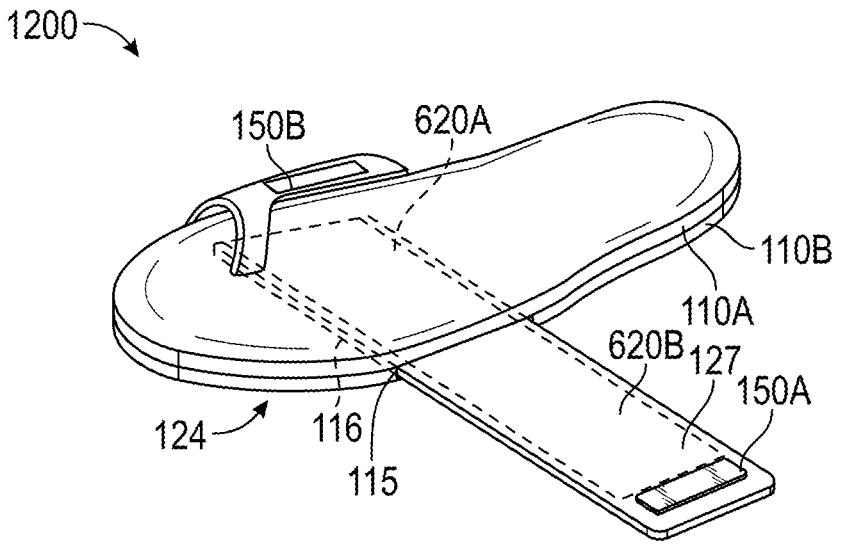
FIG. 21A is a perspective view of an article of footwear with a closure mechanism in a first stable position, according to an example embodiment of the present invention.
Figure 21B:
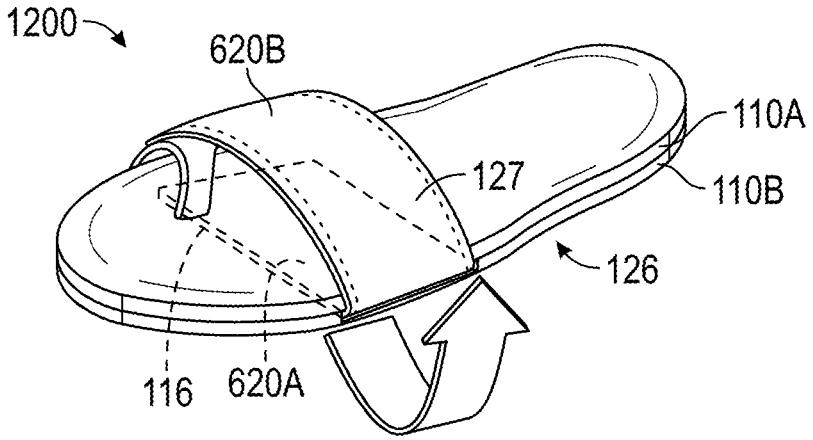
FIG. 21B is a perspective view of the article of footwear shown in FIG. 21A with the closure mechanism in a second stable position.

FIGS. 21A and 21B illustrate article of footwear 1200. As shown in FIG. 21A, article of footwear 1200 includes sole 110, enclosure 127, and securing mechanism 150 in first stable position 124. Footwear 1200 further includes a closure mechanism 620. Closure mechanism 620 includes a first portion 620A, a second portion 620B, and a top surface 622 that extends along axis X. First portion 620A extends within first cavity 116. First cavity 116 extends a portion of width 112B in midfoot portion 114B of sole 110. Second portion 620B extends away from sole 110 in a direction substantially perpendicular to outer edge 115, though in other embodiments, second portion 620B may extend away from sole 110 in a direction at an angle to outer edge 115. Second portion 620B of closure mechanism 620 includes first surface 150A of securing mechanism 150. Upper shoe portion 209 includes second surface 150B of securing mechanism 150. First portion 620A of closure mechanism 620 is configured such that application of downward force A from a user's foot to forefoot portion 114C of sole 110 deforms top surface 622 of closure mechanism 620. As shown in FIG. 21B, when in second stable position 126, first surface 150A and second surface 150B of securing mechanism 150 mate, securing article of footwear 1200 to a user's foot. While shown without a trigger mechanism in FIGS. 21A and 21B, it will be appreciated that article of footwear 1200 may include trigger mechanisms as discussed herein provided the trigger mechanism is configured to act on and/or actuate closure mechanism 620 upon application of downward force A to a portion of sole 110.

Figure 22A:
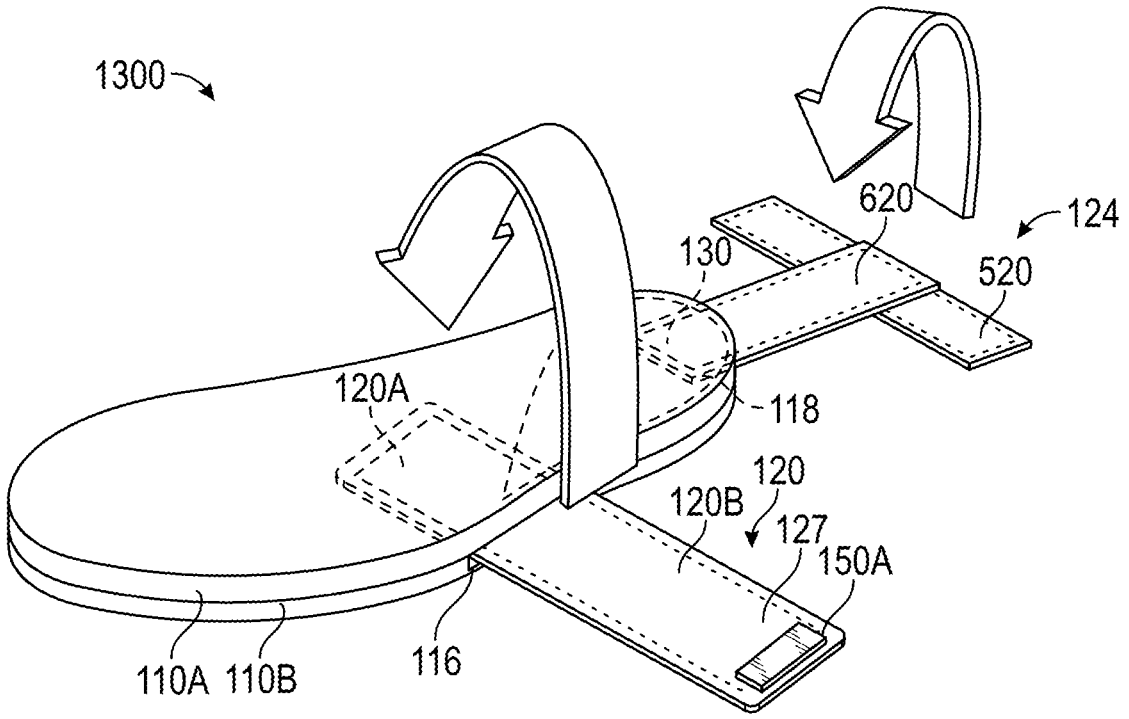
FIG. 22A is a perspective view of an article of footwear with a closure mechanisms in a first stable position, according to an example embodiment of the present invention.
Figure 22B:
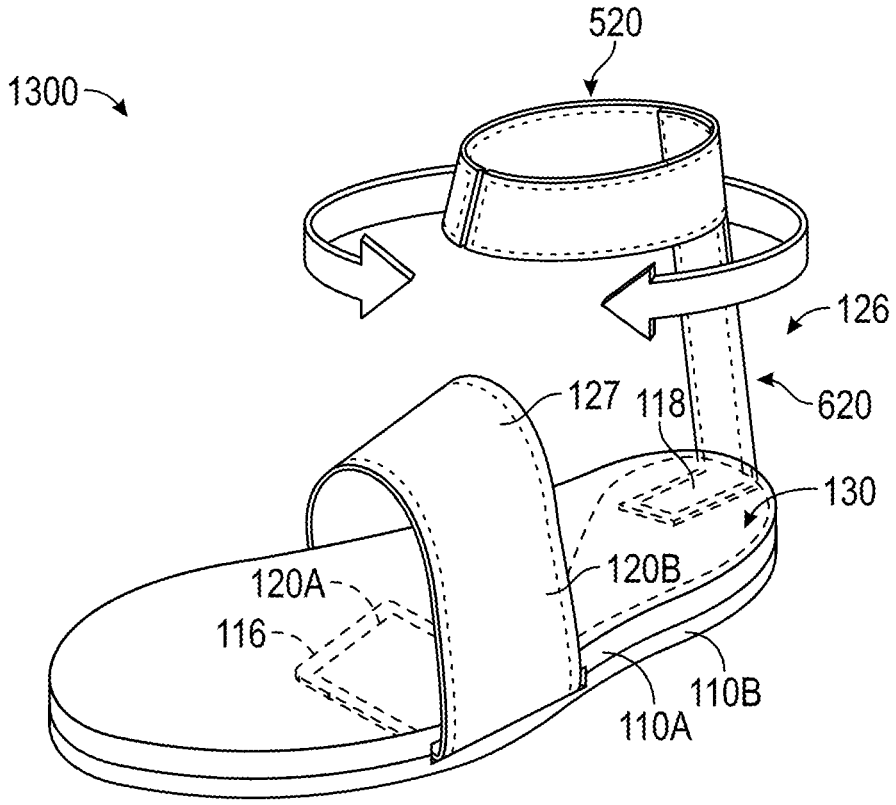
FIG. 22B is a perspective view of the article of footwear shown in FIG. 22A with the closure mechanisms in a second stable position.

FIGS. 22A and 22B illustrate article of footwear 1300 in first stable position 124 and second stable position 126, respectively. Article of footwear 1300 includes closure mechanism 120, a closure mechanism 520, and a closure mechanism 620. Second portion 120B of closure mechanism 120 extends from sole 110 at midfoot portion 114B. As shown, top surface 122 of closure mechanism 120 is deformed by trigger mechanism 130. Closure mechanism 620 extends from the rear of sole 110 at heel portion 114A in a direction substantially perpendicular to outer edge 115. Top surface 622 of closure mechanism 620 is deformed by a user applying downward force A directly to heel portion 114A of footwear 1300. Second portion 620B of closure mechanism 620 connects to closure mechanism 520. As shown in FIG. 22B, closure mechanism 520 is configured such that top surface 522 is deformed by the lower leg of a user of article of footwear 1300 after second portion 620B of closure mechanism 620 shifts to a second stable position. While shown with a specific configuration in FIGS. 22A and 22B, it will be appreciated that article of footwear 1300 may include other embodiments of closure mechanisms, trigger mechanisms, securing mechanisms, sleeves, and enclosures as discussed herein.

Embodiments of the present invention include methods of utilizing the apparatuses and systems described herein to secure articles of footwear to a user's foot.

In embodiments of the present invention, footwear may include all types of boots such as chukka boots, combat boots, cowboy boots, fashion boots, go-go boots, hiking boots, kinky boots, motorcycle boots, mukluks, platform boots, riding boots, russian boots, derby boots, thigh-length boots, tabi boots, UGG® boots, valenki, veldskoen, waders, wellington boots, winklepickers, bowling shoes, athletic shoes (also known as trainers or sneakers), brothel creepers, court shoes (also known as pumps), diabetic shoes, espadrilles, galoshes, kitten heels, lace-up shoes, derby shoes, oxford shoes, brogues, high-tops, loafers, Mary Janes, moccasins, monks, mules, platform shoes, school shoes, skate shoes, sneakers, tap shoes, sandals, flip-flops (thongs), slide, worishofer, avarcas, indoor footwear, slippers, ballet shoes, high-heeled footwear, climbing shoes, clogs, football shoes, sabaton, safety footwear, ski boots, snowshoes, surgical shoe, pointe shoes, swim fins (flippers), etc.

While embodiments herein are described with reference to various implementations and exploitations, it will be understood that these embodiments are illustrative and that the scope of the invention is not limited to them.

What is claimed is:

1. An article of footwear, comprising:

a sole having a length, a width, a heel and a midfoot portion, wherein the sole includes a first cavity extending across at least a part of the width of the midfoot portion and a second cavity extending from the heel toward the midfoot portion;

a bi-stable closure mechanism having a first portion extending within the first cavity and a second portion extending away from the sole;

a trigger mechanism within the second cavity, the trigger mechanism including an elongated rigid member that extends from the heel toward the midfoot portion, the rigid member having a first end located in the heel and a second end that acts on a surface of the first portion of the closure mechanism, wherein the first end of the rigid member is configured to receive a force from a foot of a user of the footwear and transfer the force to the second end of the rigid member, the second end of the rigid member arranged to deform the surface of the closure mechanism and thereby activate the second portion of the closure mechanism, wherein, upon activation, the second portion of the closure mechanism moves from a first stable position towards a second stable position and wraps around at least one of a top surface of the article of footwear and the user's foot;

wherein the closure mechanism includes a bi-stable spring;

wherein the bi-stable spring is substantially straight in the first stable position, wherein the bi-stable spring is an elongated piece of metal that has a curvature about its longitudinal axis such that a deformation of a convex top surface of the closure mechanism causes it to release from the first stable position and automatically wrap around an axis transverse to the longitudinal axis and towards the second stable position.

2. An article of footwear, comprising:

a sole; and a closure mechanism having a first portion attached to the sole and a second portion extending away from the sole, wherein a deformation of a surface of the closure mechanism actuates the closure mechanism such that the closure mechanism automatically moves from a first stable position towards a second stable position and conforms to and applies a force to at least one of an upper surface of the article of footwear and an upper surface of a foot of a user of the article of footwear;

wherein the closure mechanism includes a bi-stable spring;

wherein the bi-stable spring is an elongated piece of metal that has a curvature about its longitudinal axis such that a deformation of a convex top surface of the closure mechanism causes it to release from a substantially straight first stable position and automatically wrap around an axis transverse to the longitudinal axis and towards the second stable position.

3. An article of footwear, comprising:

a sole having a side portion; and an elongated spring member secured to the sole and extending from the side portion of the sole, wherein deformation of a surface of the spring member releases the spring member and causes a portion of the spring member to move from a first stable position towards a second stable position and wrap around at least one of an upper surface of the article of footwear and a foot of a user of the article of footwear.

4. The article of footwear according to claim 3, wherein the spring is an elongated piece of metal that has a curvature about its longitudinal axis such that a deformation of a convex top surface of the closure mechanism causes the portion of the spring member to release from a substantially straight first stable portion and automatically wrap around an axis transverse to the longitudinal axis and towards the second stable position.

* * * * *